US012523148B2

(12) United States Patent
Harrington et al.

(10) Patent No.: US 12,523,148 B2
(45) Date of Patent: Jan. 13, 2026

(54) SYSTEMS AND METHODS FOR DISCOVERING AND RECOVERING SUBSURFACE FLUIDS AND VERIFICATION OF SUBSURFACE STORAGE FLUIDS

(71) Applicant: Koloma, Inc., Denver, CO (US)

(72) Inventors: Jacob Harrington, Dublin, OH (US); Thomas Darrah, Westerville, OH (US); William Eymold, Columbus, OH (US)

(73) Assignee: Koloma, Inc., Denver, CO (US)

( * ) Notice: Subject to any disclaimer, the term of this patent is extended or adjusted under 35 U.S.C. 154(b) by 0 days.

(21) Appl. No.: 18/943,698

(22) Filed: Nov. 11, 2024

(65) Prior Publication Data

US 2025/0067175 A1 Feb. 27, 2025

Related U.S. Application Data

(63) Continuation of application No. 18/191,732, filed on Mar. 28, 2023.

(60) Provisional application No. 63/325,094, filed on Mar. 29, 2022.

(51) Int. Cl.
*E21B 49/08* (2006.01)
*E21B 49/00* (2006.01)

(52) U.S. Cl.
CPC ..... *E21B 49/0875* (2020.05); *E21B 49/005* (2013.01); *E21B 2200/20* (2020.05); *E21B 2200/22* (2020.05)

(58) Field of Classification Search
CPC ..... E21B 49/0875; E21B 49/005; E21B 2200/20; E21B 2200/22
See application file for complete search history.

(56) References Cited

U.S. PATENT DOCUMENTS 3,240,938 A * 3/1966 Hall, Jr. ..... G01V 5/145 376/165
3,247,377 A * 4/1966 Hall, Jr. ..... G01V 5/104 250/269.2
3,590,228 A * 6/1971 Burke ..... G01V 11/002 367/27
4,416,151 A * 11/1983 Ullo ..... G01V 5/107 73/152.05
2002/0029885 A1* 3/2002 de Rouffignac ..... E21B 43/24 166/57
2008/0175099 A1 7/2008 Hawthorn
2020/0166667 A1 5/2020 Dræge
2022/0252756 A1 8/2022 Haceb

* cited by examiner

*Primary Examiner* — Yanick A Akaragwe
(74) *Attorney, Agent, or Firm* — K&L Gates LLP

(57) ABSTRACT

Embodiments of the invention relate to methods, systems, and software for identifying and quantifying subsurface hydrogen, helium, carbon dioxide, or other fluids using multiple indicia from geophysical well logs, other wireline logging tools, or mudlogging tools.

17 Claims, 8 Drawing Sheets

| WELL# | X-coord. | Y-coord. |
|---|---|---|
| 1 | 3 | 8 |
| 2 | 2 | 6 |
| 3 | 5 | 7 |
| 4 | 6 | 6 |

| Depth(ft.) | Fluid Type Output |
|---|---|
| 500-1000 | Methane |
| 1500-2000 | Hydrogen |
| 3000-3500 | Carbon Dioxide |

| WELL# | X-coord. | Y-coord. |
|---|---|---|
| 1 | 3 | 8 |
| 2 | 2 | 6 |
| 3 | 5 | 7 |
| 4 | 6 | 6 |

| Depth(ft.) | Fluid Type Output |
|---|---|
| 500-1000 | Methane |
| 1500-2000 | Water |
| 3000-3500 | Carbon Dioxide |

SYSTEMS AND METHODS FOR DISCOVERING AND RECOVERING SUBSURFACE FLUIDS AND VERIFICATION OF SUBSURFACE STORAGE FLUIDS

CROSS-REFERENCE TO RELATED APPLICATIONS

This application is a continuation of U.S. application Ser. No. 18/191,732, filed Mar. 28, 2023, which claims benefit to U.S. Provisional Application No. 63/325,094, filed Mar. 29, 2022, the entire disclosures of each of which are incorporated herein by reference.

BACKGROUND

Subsurface rock formations have pores therein. The pores or pore space is defined by the rock matrix of the rock formation and may hold any of various fluids such as hydrocarbons, water, hydrogen, carbon dioxide, helium, or the like. Where the porosity of a subsurface rock formation is sufficiently large enough, a reservoir of fluid may be contained with the subsurface rock formation. Such reservoirs may be accessed to extract the fluids therein.

There are many existing wells extending into subsurface rock formations around the world. Well logs including information on the geophysical characteristics of the rock matrices and contents thereof are available for many of these wells. However, many of these well logs only focus on finding one type of fluid, such as oil.

SUMMARY

Embodiments of the invention relate to methods, systems, and software for identifying and quantifying subsurface hydrogen, helium, carbon dioxide, or other fluids using multiple indicia from geophysical well logs, other wireline logging tools, or mudlogging tools.

In an embodiment, a method for identifying subsurface fluids in geological formations is disclosed. The method includes determining a rock matrix type of a rock formation at a geological area of interest. The method includes determining a porosity of the rock formation. The method includes determining a fluid density of a fluid within a pore space of the rock formation. The method includes determining an acoustic slowness of the fluid within the pore space. The method includes determining a fluid type of the fluid within the pore space.

In an embodiment, a system for identifying subsurface fluids in geological formations is disclosed. The system includes a computing device having a processor and memory storage operably coupled to the processor, the memory storage having one or more operational programs including machine readable and executable instructions for identifying one or more selected fluids within a pore space of a rock formation based on data from one or more well logs, and the processor being configured to read and execute the one or more operational programs. The data from the one or more well logs indicate one or more of a rock matrix type of the rock formation, a fluid density of the fluid within the pore space, or an acoustic slowness of the fluids within the pore space.

In an embodiment, a method for identifying subsurface fluids in a geological formation is disclosed. The method includes identifying a geological area of interest. The method includes determining a rock matrix type of a rock formation at the geological area of interest. The method includes determining a porosity of the rock formation. The method includes determining a fluid density of a fluid within a pore space of the rock formation. The method includes determining an acoustic slowness of the fluid within the pore space. The method includes determining a fluid type of the fluid within the pore space. The method includes flagging a presence of selected fluid types.

In an embodiment, a method for differentiating hydrogen from other subsurface fluids is disclosed. The method includes differentiating hydrogen from hydrocarbon fluids or other subsurface fluids using geophysical acoustic logs. The method includes differentiating hydrogen from water using geophysical density logs.

In an embodiment, a method for differentiating carbon dioxide from other subsurface fluids is disclosed. The method includes differentiating carbon dioxide from hydrocarbon fluids or other subsurface fluids using geophysical acoustic logs. The method includes differentiating carbon dioxide from water using geophysical density logs.

In an embodiment, a method for differentiating hydrogen injected into the subsurface from other subsurface fluids is disclosed. The method includes differentiating hydrogen obtained from various industrial sources from hydrocarbon fluids or other subsurface fluids using geophysical acoustic logs. The method includes differentiating hydrogen obtained from various industrial sources from water using geophysical density logs.

In an embodiment, a method for differentiating carbon dioxide injected into the subsurface in gaseous or supercritical form from other subsurface fluids is disclosed. The method includes differentiating carbon dioxide obtained from various industrial sources from hydrocarbon fluids or other subsurface fluids using geophysical acoustic logs. The method includes differentiating carbon dioxide obtained from various industrial sources from water using geophysical density logs.

In an embodiment, a method for identifying and quantifying hydrogen in subsurface formation is disclosed. The method includes using geophysical logs, including one or more of acoustic logs or density logs, to identify and quantify hydrogen in the subsurface formation.

In an embodiment, a method for identifying and quantifying carbon dioxide in subsurface formations is disclosed. The method includes using geophysical logs, including one or more of acoustic logs or density logs, to identify and quantify carbon dioxide in the subsurface.

In an embodiment, a method for identifying and quantifying helium in subsurface formations is disclosed. The method includes using geophysical logs, including one or more of acoustic logs or density logs, to identify and quantify helium in the subsurface.

In an embodiment, a method for exploration of hydrogen in a subsurface formation is disclosed. The method includes using geophysical log patterns characteristic of hydrogen to identify accumulations of hydrogen in the subsurface formation.

In an embodiment, a method for exploration of carbon dioxide in a subsurface formation is disclosed. The method includes using geophysical log patterns characteristic of carbon dioxide to identify accumulations of carbon dioxide in the subsurface formation.

In an embodiment, a method for exploration of helium in a subsurface formation is disclosed. The method includes using geophysical log patterns characteristic of helium to identify accumulations of helium in the subsurface formation.

In an embodiment, a method for verifying storage of hydrogen in subsurface reservoirs is disclosed. The method includes using geophysical log patterns characteristic of hydrogen to identify accumulations of hydrogen in the subsurface reservoirs.

In an embodiment, a method for verifying the storage of carbon dioxide in subsurface reservoirs is disclosed. The method includes using geophysical log patterns characteristic of carbon dioxide to identify accumulations of carbon dioxide in the subsurface reservoirs.

In an embodiment, a method for verifying the sequestration of carbon dioxide in subsurface minerals is disclosed. The method includes using geophysical log patterns characteristic of carbon dioxide to identify accumulations of carbon dioxide in the subsurface minerals.

In an embodiment, a computer-assisted method to differentiate hydrogen from other subsurface fluids is disclosed. The method includes, with a computing device, automatically differentiating hydrogen from helium, nitrogen, carbon dioxide, or hydrocarbon fluids using geophysical acoustic logs. The method includes, with a computing device, automatically differentiating hydrogen from water using geophysical density logs.

In an embodiment, a computer-assisted method for identifying and quantifying hydrogen in subsurface formations is disclosed. The method includes, with a computing device, automatically using geophysical logs including one or more of acoustic logs or density logs, to identify and quantify hydrogen in the subsurface formations.

In an embodiment, a computer-assisted method for the exploration of hydrogen in subsurface formations is disclosed. The method includes, with a computing device, automatically using geophysical log patterns characteristic of hydrogen to automatically identify accumulations of hydrogen in the subsurface formations with a computer-assisted operational program composed to search existing or archived geophysical well logs for a presence of hydrogen in the subsurface.

In an embodiment, a computer-assisted method to differentiate carbon dioxide from other subsurface fluids is disclosed. The method includes, with a computing device, automatically differentiating carbon dioxide from hydrocarbon fluids using geophysical acoustic logs. The method includes, with a computing device, automatically differentiating carbon dioxide from water using geophysical density logs.

In an embodiment, a computer-assisted method for identifying and quantifying carbon dioxide in subsurface formations is disclosed. The method includes, with a computing device, automatically using geophysical logs, including one or more of acoustic logs or density logs, to identify and quantify carbon dioxide in the subsurface formations.

In an embodiment, a computer-assisted machine learning method for the exploration of carbon dioxide in the subsurface is disclosed. The method includes, with a computing device, automatically using geophysical log patterns characteristic of carbon dioxide to identify prospective accumulations of carbon dioxide in the subsurface. The method includes, with a computing device, automatically using an operational program stored on the computing device to search existing or archived geophysical well logs for the presence of carbon dioxide.

In an embodiment, a computer-assisted method to differentiate helium from other subsurface fluids is disclosed. The method includes, with a computing device, automatically differentiating helium from hydrocarbon fluids using geophysical acoustic logs. The method includes, with a computing device, automatically differentiating helium from water using geophysical density logs.

In an embodiment, a computer-assisted method for identifying and quantifying helium in subsurface formations is disclosed. The method includes, with a computing device, automatically using geophysical logs, including one or more of acoustic logs or density logs, to identify and quantify helium in the subsurface formations.

In an embodiment, a computer-assisted machine learning method for the exploration of helium in the subsurface is disclosed. The method includes, with a computing device, automatically using geophysical log patterns characteristic of helium to identify prospective accumulations of helium in the subsurface. The method includes, with a computing device, automatically using an operational program stored on the computing device to search existing or archived geophysical well logs for the presence of helium.

In an embodiment, a method of identifying subsurface hydrogen, helium, or carbon dioxide is disclosed. The method includes using an image recognition module to automatically analyze geophysical or borehole images for patterns characteristic of subsurface hydrogen, helium, or carbon dioxide to identify accumulations of hydrogen, helium, or carbon dioxide in the subsurface. The method includes outputting results of the analysis of the geophysical log images.

In an embodiment, a method of identifying subsurface hydrogen, helium, or carbon dioxide is disclosed. The method includes receiving information on an imaged or digitized well log, the information including well log characteristics. The method includes estimating a likelihood that the well log characteristics are indicative of subsurface hydrogen, helium, or carbon dioxide accumulations. The method includes determining if the estimated likelihood satisfies a predetermined threshold for likelihood of the presence of subsurface hydrogen, helium, or carbon dioxide accumulations. The method includes responsive to determining if the estimated likelihood satisfies a predetermined threshold, outputting an indication that the well log characteristics are or are not indicative of the presence of subsurface hydrogen, helium, or carbon dioxide accumulations.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

For better understanding, the like elements have been designated by like reference numbers throughout the various accompanying figures. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION

Embodiments of the invention relate to methods, systems, and software for identifying and quantifying subsurface hydrogen, helium, carbon dioxide, or other fluids using multiple indicia from geophysical well logs, other wireline logging tools, or mudlogging tools. The methods, systems, and software may be used in exploration for occurrences of hydrogen, helium, carbon dioxide, or other subsurface gases; monitoring or quantification of the storage of these gases in the subsurface; tracking of carbon dioxide during storage or enhanced oil recovery; and assessment and quantification of carbon sequestration by mineralization in the subsurface. The methods, systems, and software disclosed herein utilize relationships between density and acoustic properties of different rock types and fluid types which may be assessed using visual inspection, core analyses, borehole images, quantitative analysis, and supervised or unsupervised computer-assisted machine learning to determine the occurrence and quantify the presence of hydrogen, helium, carbon dioxide, or other fluids in the subsurface.

Figure 1:
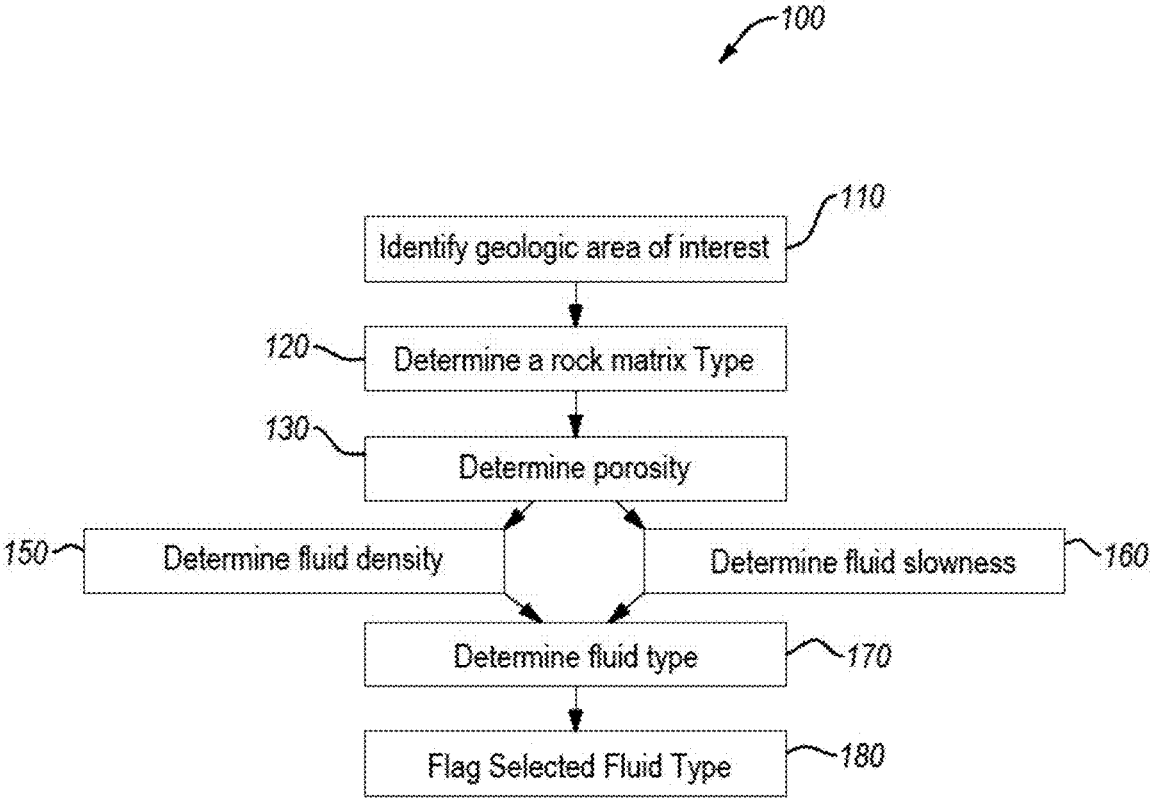
FIG. 1 is a flow chart a method of identifying specific fluids in geological formations, according to an embodiment.

FIG. 1 is a flow chart a method 100 of identifying specific fluids in geological formations, according to an embodiment. The method 100 includes identifying the geologic area of interest at block 110; determining a rock matrix type of a rock formation at the geological area of interest at block 120; determining the porosity of the rock formation at block 130; determining a fluid density of a fluid within pore space of the rock formation at block 150; determining an acoustic slowness of the fluid within pore space at block 160; determining the fluid type of the fluid within the pore pace at block 170; and flagging the determinations of selected fluid types at block 180. One or more of the blocks 110-180 may be combined, omitted, or split into multiple blocks according to embodiments. For example, the method 100 may not include the optional block 140 or blocks 150 and 160 may be combined into a single block. As discussed in more detail below, additional blocks may be added to the method 100 in some embodiments.

The method 100 is used to solve for fluid characteristics, such as density and acoustic slowness, from geophysical well logs to identify specific fluids, such as hydrogen, helium, carbon dioxide, or natural gases in geological formations. The method 100 is used to identify and quantify different subsurface fluids, such as hydrogen, helium, carbon dioxide, natural gas, or other fluids within a geological formation. Additionally, the relative amounts of the fluids may also be determined using the method 100. Determining a relative amount of the fluids within the pore space may be accomplished by comparing the calculated $\Delta t_{fluid}$ from the method 100 to acoustic slownesses of combinations of one or more subsurface fluids.

Identifying the geological area of interest at block 110 may include selecting a geological location, including one or more of longitudinal and lateral locations, depths (e.g., subsurface interval(s)), or the like. The geological area of interest may include one or more wells, such as a field.

At block 110, the geologic area of interest is identified. An entry into a computer program identifying the geologic area of interest may be used. Identifying the geological area of interest at block 110 may include selecting, accessing, or examining one or more geophysical well logs corresponding to a geographical area of interest.

Determining a rock matrix type of a rock formation at a geological area of interest at block 120 may include determining a rock matrix type in one or more subsurface intervals of the rock formation. Determining a rock matrix type may include examining one or more geophysical well logs, such as automatically with a computing device. The information in the well logs may include rock matrix type or one or more properties associated therewith. For example, the rock matrix type may be indicated in image logs, resistivity, gamma ray readings, or the like. Such data may be located in geophysical well logs (including image logs) and may be identified and obtained by an image processing program stored in a computing device.

Determining a rock matrix type of a rock formation at a geological area of interest may be achieved using available records for the geologic area of interest including geophysical well logs (e.g., gamma ray logs and spontaneous potential logs), or by other means of assessment (e.g., mudlogging, visual inspection of cuttings or cores, mineralogical assessment, x-ray diffraction, x-ray fluorescence, or other geochemical or optical measurement or process) of subsurface formations if cuttings or cores are retrieved from the subsurface. Such identification may be accomplished using computer aided or other techniques. For example, the rock matrix of a given subsurface interval may be interpreted from geophysical well logs and validated or cross-referenced with the other means described herein.

Based on the rock matrix type, the rock matrix density may be determined or inferred. For example, known densities of some common subsurface materials are provided in Table 1 below. The rock matrix density may be used to determine further properties of the rock formation and contents thereof.

In embodiments, a bulk density measurement from a geophysical logging tool results from the combination of the rock matrix density, the pore fluid density, and the relative proportions of each therein. Rocks may develop porosity from the way grains settle upon deposition or from secondary diagenetic processes, such as chemical and mechanical weathering, or fracturing or may close porosity by compaction, cementation, or layer-parallel shortening. Water or brine (salty water) initially fills pore space during typical sedimentation processes, but water may be displaced by other fluids, such as oil, natural gas, hydrogen, helium, or carbon dioxide, as they migrate through that rock in the subsurface. Given a constant porosity and rock matrix, the bulk density measurement will vary according to that pore-filling fluid. Water is denser than oil or natural gas, and hydrogen and helium are much less dense than any other fluid that may be found in these subsurface rocks.

Rock material typically behaves as an insulator and its elevated conductivity measurements usually result from the presence of pore fluids therein, often a combination of water and hydrocarbons or other gas species. Resistivity is the inverse of conductivity and is a property of the rock that may be measured to characterize the formation. The range of resistivity in reservoir rocks may span more than three orders of magnitude from shale below 10 Ω·m to tight limestones in excess of 1,000 Ω·m. Drilling fluids are able to penetrate the formation during the drilling process, requiring multiple resistivity tools with varying measurement depths to be run. Resistivities from deeper intact zones may be compared to shallower invaded zones that have been affected by the drilling mud used (e.g., oil or water based). Changes in resistivity may indicate changes in pore fluid (e.g., water to hydrocarbon or other gases), or potentially changes to porosity and permeability. Data from resistivity logs may be used to calibrate other measurements or determine for instance more intact representative values for sections of the well (e.g., true density of unfractured/unaltered lithology).

An acoustic measurement from a geophysical logging tool results from the combination of the speed at which sound travels through rock formation including the rock matrix, the pore fluid, and the relative proportions of those two components of the rock formation. This speed of sound property is also described as the interval transit time. Just as the speed of sound through air is different than through water, different rocks have different acoustic properties, as well as the various fluids that may fill their pore space. Natural gas, principally methane, has a much slower interval transit time than other rock types found in the subsurface. Methane also has a much slower interval transit time than water, hydrogen, or helium. Hydrogen, on the other hand, has an interval transit time similar to water, helium is ~30% slower than hydrogen or water, and methane and carbon dioxide (in the gaseous or super-critical form) have transit times much slower than water.

Other geophysical well logs may be used to determine subsurface characteristics, most notably geologic properties of reservoirs. Downhole gamma ray tools measure (in API units) the natural radiation emitted from rock, largely due to the radioactive decay of uranium, thorium, and potassium found in the mineral matrix, and may be useful in differentiating rock types. Carbonate rocks such as limestone and dolomite generally have low concentrations of these elements and, as a result, low gamma ray readings. Shales often have relatively high uranium concentrations (e.g., 3-250 parts per million) which is reflected in higher gamma readings. Sandstones often have concentrations of the above-noted elements and provide gamma readings in between the previous two examples, with variations dependent on potassium from potassium feldspar mineral grains in the rock.

Determining the porosity of the rock formation at block 130 may include determining the porosity of the rock formation at the one or more subsurface intervals at the geological area of interest. Determining porosity of the rock formation at block 130 may include obtaining porosity data directly (e.g., on-site testing of the rock matrix) or from one or more geophysical well logs. For example, a neutron porosity tool is a useful geophysical well log for characterizing porosity of a rock formation by measuring the interactions of neutrons emitted from a radioactive source with the rock matrix and fluids contained in the pore space of the rock formation. "Pore space" as used herein includes the singular and plural meanings of pore space and pore spaces. For example, "pore space" includes the volume of the pores defined by the rock matrix in a rock formation and may include crack volume, spaces between rock particles, and the like. The pore space may include a plurality of pore spaces interconnected (e.g., fluidly connected) throughout a rock formation. Image logs may be evaluated to indicate rock integrity and identify zones of intense fracturing. The baseline characteristics of a formation (e.g., density or porosity) may be determined from log measurements collected in portions of the well (e.g., rock formation at discrete subsurface locations or intervals) that are shown to be intact via an image log. Resistivity values may also indicate where porosity is truly minimal in lithologies which density or neutron porosity logs have not been properly calibrated (e.g., in igneous rock). The porosity may be taken directly from or calculated from geophysical well log data for one or more subsurface intervals at the geological area of interest. For example, a computer program may identify and obtain the porosity value(s) for the rock matrix in the rock formation.

Determining the porosity of the rock formation at block 130 may include other means of assessment such as microscopy, porosimetry, or geochemical measurement of subsurface formations if cuttings or cores are retrieved from the subsurface. These data provide the matrix density and porosity inputs for Equations 1-2 below, examples of which are shown in Tables 1-3 below. These data are used to solve for fluid density and acoustic slowness of the fluid in the pore space as explained in more detail below.

Porosity may be used to calculate the fluid acoustic and density responses in Equations 1 and 2 (below). To demonstrate this technique, properties of commonly found rock types and fluids may be used in calculations. Tables 1 and 2 display characteristic density properties and acoustic slowness values of various rock and mineral types (e.g., sandstone, limestone, dolomite, gabbro, serpentine). Table 3 displays the acoustic slowness of various endmember fluids (water, hydrogen, helium, methane, nitrogen, and carbon dioxide).

TABLE 1

Input values for various rock matrix densities.

| Rock Matrix | Density ($g/cm^3$) |
|---|---|
| Anhydrite | 2.96 |
| Apatite | 3.19 |
| Basalt | 2.90 |
| Chlorite | 2.75 |
| Clay | 1.70 |
| Coal | 1.40 |
| Dolomite | 2.85 |
| Feldspar | 2.56 |
| Gabbro | 3.05 |
| Graphite | 2.70 |
| Gypsum | 2.96 |
| Halite | 2.17 |
| Hematite | 5.30 |
| Limestone | 2.71 |
| Magnetite | 5.18 |
| Olivine | 3.32 |
| Pyrite | 4.85 |
| Quartz | 2.65 |
| Sandstone | 2.65 |

TABLE 1-continued

Input values for various rock matrix densities.

| Rock Matrix | Density ($g/cm^3$) |
|---|---|
| Serpentine | 2.53 |
| Shale | 2.46 |
| Talc | 1.75 |

TABLE 2

Input values for various rock matrix acoustic slownesses.

| Rock Matrix | Acoustic Slowness (μs/ft) |
|---|---|
| Anhydrite | 54.0 |
| Basalt | 51.6 |
| Coal | 120.0 |
| Dolomite | 43.5 |
| Gabbro | 45.5 |
| Granite | 50.0 |
| Hematite | 46.0 |
| Limestone | 47.5 |
| Pyrite | 38.0 |
| Quartz | 51.0 |
| Sandstone | 55.5 |
| Shale | 70.0 |

TABLE 3

Example input values for various fluid acoustic slownesses and densities.

| Pore Fluid | Acoustic Slowness (μs/ft) | Density ($g/cm^3$) |
|---|---|---|
| Hydrogen | 240 | $9.00 \times 10^{-5}$ |
| Water | 200 | 1.00 |
| Helium | 313 | $1.79 \times 10^{-4}$ |
| Methane | 683 | $6.00 \times 10^{-4}$ |
| Nitrogen | 873 | $1.25 \times 10^{-3}$ |
| Carbon Dioxide (50° C. and 50 Bar) | 1086 | 0.125 |
| Supercritical Carbon Dioxide (50° C. and 76 Bar) | 902 | 0.288 |

The data in Tables 1-3 may be used to determine fluid density and acoustic slowness using Equations 1 and 2 below. To demonstrate this technique, there are commonly found rock types and fluids provided in a hypothetical test scenario. Tables 1 and 2 display characteristic density properties and acoustic slowness values of various rock and mineral types (e.g., sandstone, limestone, dolomite, gabbro, serpentine). Table 3 displays the acoustic slowness of various endmember fluids (water, hydrogen, helium, methane, nitrogen, and carbon dioxide). Providing an assumption of different porosity fractions the different outcomes of log responses may be calculated using Equations 1 and 2.

Equations 1 and 2 below describe the relationship between a measured density or acoustic log response and the density or acoustic properties of the rock matrix and pore fluid.

$$\Delta t_{log} = (\Phi) * \Delta t_{fluid} + (1 - \Phi) * \Delta t_{matrix}, \quad \text{Equation 1}$$

where:

$\Delta t_{log}$=acoustic slowness (e.g., interval transit time measured by an acoustic log tool) (μs/ft)

$\Phi$=porosity of the rock formation expressed as a fraction (e.g., 10%=0.1)

$\Delta t_{fluid}$=acoustic slowness or interval transit time of the fluid contained in the pore space(s) (μs/ft)

$1-\Phi$=volume fraction of rock in the rock formation expressed as a fraction (e.g., 90%=0.9)

$\Delta t_{matrix}$=interval transit time of the rock matrix (μs/ft)

Equation 1 shows the acoustic log response ($\Delta t_{log}$) is equal to the porosity fraction of the rock formation ($\Phi$) multiplied by the interval transit time of the pore fluid in the rock formation ($\Delta t_{fluid}$ also referred to as the acoustic slowness of the pore fluid) plus the remaining volume fraction of the rock formation ($1-\Phi$) multiplied by the interval transit time of the rock matrix ($\Delta t_{matrix}$). Equation 1 may be rearranged to solve for acoustic slowness of the fluid ($\Delta t_{fluid}$). The acoustic slowness ($\Delta t_{fluid}$) may be used to later identify the fluid within the pore space in the rock matrix of a rock formation.

$$\rho_{log} = (\Phi) * \rho_{fluid} + (1 - \Phi) * \rho_{matrix}, \quad \text{Equation 2}$$

$\rho_{log}$=bulk density measured by a density log tool ($g/cm^3$)

$\Phi$=porosity of the rock formation expressed as a fraction (e.g., 10%=0.1)

$\rho_{fluid}$=fluid density of the fluid contained in the pore space(s) ($g/cm^3$)

$1-\Phi$=volume fraction of rock in the rock formation expressed as a fraction (e.g., 90%=0.9)

$\rho_{matrix}$=density of the rock matrix ($g/cm^3$)

Equation 2 shows the density log response ($\rho_{log}$) is equal to the porosity fraction ($\Phi$) multiplied by the fluid density ($\rho_{fluid}$) plus the remaining volume fraction ($1-\Phi$) multiplied by the rock matrix density ($\rho_{matrix}$). Equation 2 may be rearranged to solve for $\rho_{fluid}$. Any of the variables in Equations 1-3 may be present in geophysical well logs or other logs and may be obtained by an image or data analysis component of a computer program used to identify said information. The fluid density ($\rho_{fluid}$) may be used to later identify the fluid within the pore space in the rock matrix.

Equations 1 and 2 describe a scenario where a single fluid occupies the pore space in a rock matrix of a rock formation. As a result, the presented values are endmembers, while natural systems may display intermediate values consistent with mixtures of multiple fluids. For multiple fluid mixtures, the relative porosity fractions of the fluids should be multiplied by the relative fluid density or interval transit time corresponding thereto and summed.

The presence of the multiple pore fluids may combine to affect the acoustic slowness and density measured (e.g., fluid density will equal the proportional sum of the density from each component and the acoustic slowness may be calculated from the proportional sum of the acoustic slownesses from each component). For example, utilizing Equations 1 and 2, it may be determined that a mixture of 50% water and 50% hydrogen in a sandstone matrix with 20% porosity would yield a $\rho_{log}$ of 2.22 $g/cm^3$ (e.g., sum of rock, water, and hydrogen contributions gives $0.8\times2.65$ $g/cm^3$+$0.1\times1.0$ $g/cm^3$+$0.1\times1.79\times10^{-4}$ $g/cm^3$) and $\Delta t_{log}$ of 88.4 μs/ft (e.g., the sum of rock, water, and hydrogen contributions gives 0.8×55.5 μs/ft+0.1×200 μs/ft+0.1×240 μs/ft). Using the same approach, a mixture of 25% water and 75% hydrogen would yield a $\rho_{log}$ of 2.17 g/cm$^3$ and a $\Delta t_{log}$ of 90.4 μs/ft and by comparison, a 50% water and 50% methane mixture in the same matrix would yield a $\rho_{log}$ of 2.22 g/cm$^3$ and a $\Delta t_{log}$ of 132.7 μs/ft. Because the density and acoustic slownesses may be non-unique (i.e., identical values may result from multiple combinations of fluids), the likelihood and range of fluid compositions may be predicted via simulations (e.g., Monte Carlo). However, such a technique may utilize information collected from additional logs (e.g., resistivity logs) and laboratory experiments (e.g., flood experiments to determine effects of fluid composition on acoustic slowness in rock samples) to improve accuracy of the calculations based thereon.

Based at least in part on the determined fluid types and relative amounts thereof, the amount of one or more selected fluids in the rock formation may be quantified. For example, the relative amount of (e.g., percentage of pore space filled with) the fluid(s) in the rock formation may be multiplied by the size of the rock formation (determined from multiple wells confirming rock formation size in a well field) and the volume of the pore space therein to calculate an estimated volume of the selected fluid(s) in the subsurface intervals or the entire rock formation.

The presence of hydrogen within the rock porosity may register different signals based on the confining lithology. Data from well logs may be analyzed by utilizing a computational program that calculates the acoustic and density responses and identifies the corresponding subsurface intervals which exhibit specified response values (e.g., response values indicating the target fluid of interest). When hydrogen gas exists in sedimentary formations for instance, the signature may resemble more traditional oil and gas observations such as gas crossover albeit with a lower slowness value than that of oil or methane.

As noted above, the porosity of the rock formation (e.g., porosity from well logs or measured porosity) may be used to accurately determine one or more of fluid density or acoustic slowness of fluid(s) in pore space in blocks 150 and 160.

Determining a fluid density of a fluid within a pore space of the rock formation at block 150 includes calculating the fluid density of the fluid(s) within the pore space using Equation 2. For example, Equation 2 may be rearranged to solve for $\rho_{fluid}$. One or more values for the variables in Equation 2 may be obtained from well logs and input into the rearranged Equation 2. A computer program may be utilized to automatically identify values for one or more of the variables in Equation 2 in geophysical well logs and calculate the fluid density ($\rho_{fluid}$) of fluid(s) at the corresponding subsurface interval based thereon. Accordingly, the highly difficult data acquisition, determinations, and calculations associated therewith may be accomplished automatically and with great speed to determine the fluid density. One or more of the variables may be obtained from different well logs, such as some from a downhole gamma ray log, a photoelectric factor geophysical log, an acoustic log, or any of the logs disclosed herein. For example, a computer program may identify and use bulk density log measurements to solve for fluid density, $\rho_{fluid}$, the last remaining variable of the density equation (Equation 2).

If the fluid density ($\rho_{fluid}$) is much less than 1.00 g/cm$^3$, such as less than 0.8 g/cm$^3$, the fluid is likely in the gas phase, leading to the options of methane, hydrogen, helium, nitrogen, mixed hydrocarbon gases, dihydrogen sulfide, carbon dioxide, or mixtures thereof.

Determining a fluid density of the fluid within the pore space of the rock formation may include determining the fluid density of the fluid(s) at the one or more subsurface intervals within pore space at the geological area of interest. Accordingly, the method 100 may determine fluid density for some or all of the subsurface intervals in a geological formation or well therein.

Figure 2A:
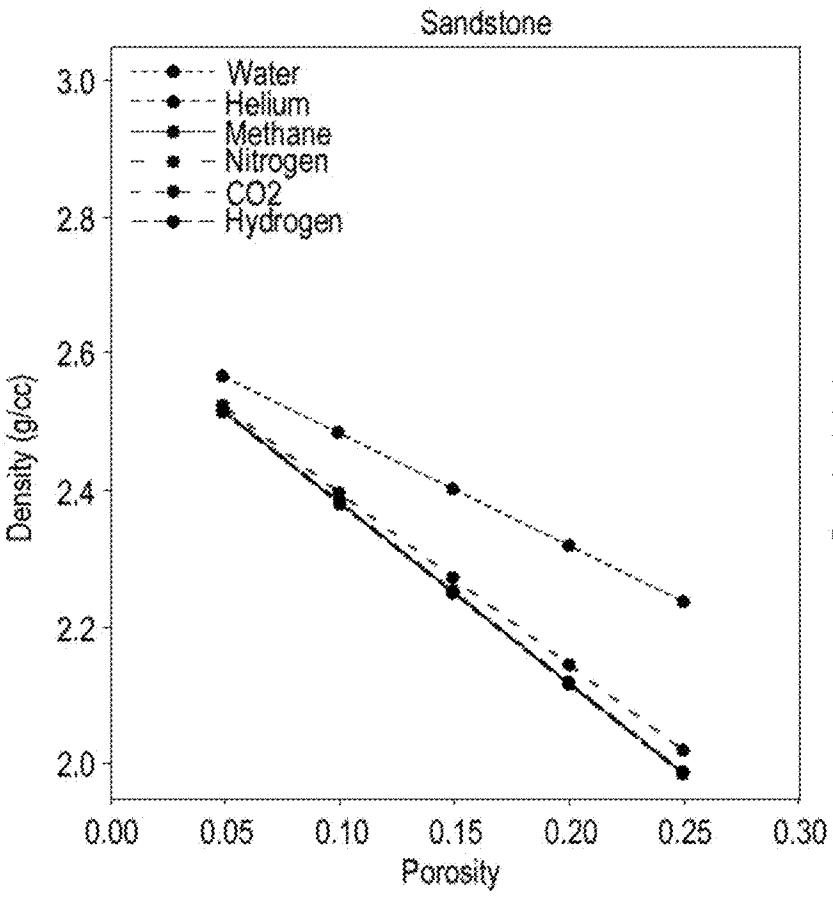
FIGS. 2A and 2B are graphical reproductions of expected density log responses for different endmember gases across a range of porosities for an assumed sandstone and gabbro matrix, respectively.
Figure 2B:
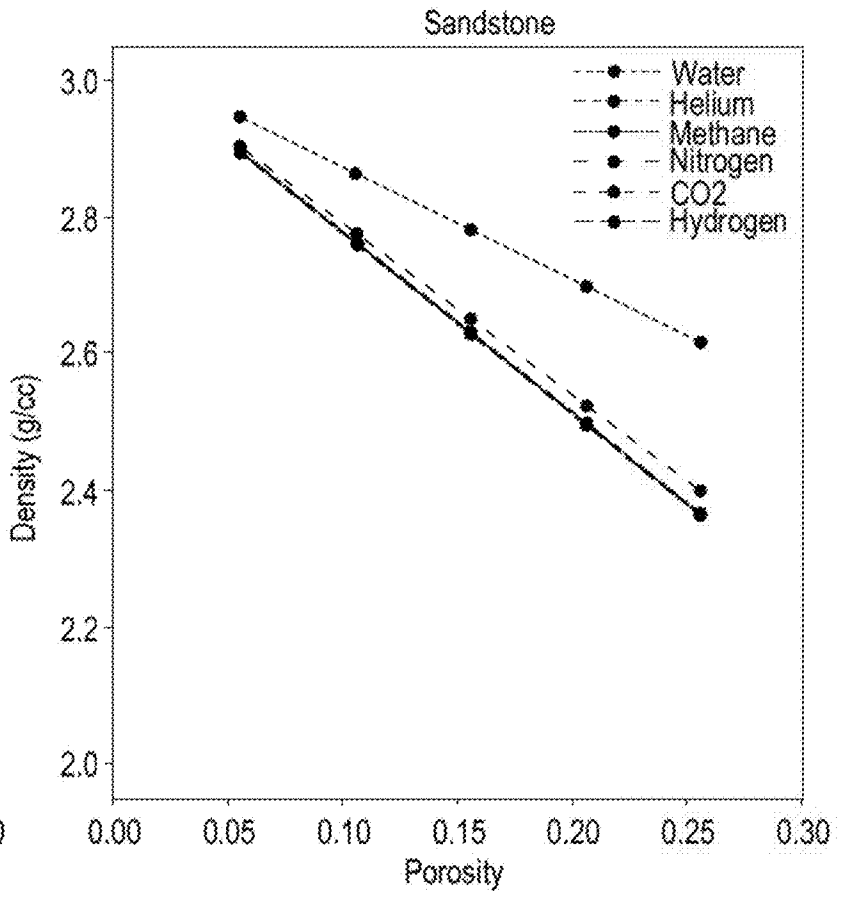

FIGS. 2A and 2B are graphical reproductions of expected density log responses for different endmember gases across a range of porosities for an assumed sandstone (left) and gabbro (right) matrix, respectively. More specifically, FIGS. 2A and 2B are graphical reproductions of the calculated density log outputs following Equation 3 and inputs in Tables 1-3. The outputs are calculated for different density log responses for hypothetical sections with porosity ranging from 5% to 25% and filled with varying proportions of water, hydrogen, helium, methane, nitrogen, gaseous carbon dioxide, and supercritical carbon dioxide using Equation 3. As shown in FIGS. 2A and 2B, based on the similar densities between each of the chosen gases, hydrogen, helium, methane, and nitrogen are nearly indistinguishable from each other, although all of these gases may be easily distinguished from water or carbon dioxide in the gaseous or super-critical form.

The inputs for Equation 1 (the acoustic equation) are known once the rock type and porosity have been determined, such as from well logs as described herein.

Determining an acoustic slowness of the fluid (e.g., fluid slowness or interval transit time) within the pore space at block 160 includes calculating the acoustic slowness of the fluid(s) within the pore space using Equation 1. For example, Equation 1 may be rearranged to solve for $\Delta t_{fluid}$. One or more values for the variables in Equation 1 may be obtained from well logs and input into the rearranged Equation 1. A computer program may be utilized to automatically identify values for one or more of the variables in Equation 1 in geophysical well logs and calculate the fluid slowness of fluid(s) at the corresponding subsurface interval based thereon. One or more of the variables may be obtained from different well logs, such as some from a downhole gamma ray log, a photoelectric factor geophysical log, an acoustic log, or any of the logs disclosed herein. For example, an acoustic log interval transit time (e.g., bulk transit time through the fluid(s) in the pore spaces) may be obtained from an acoustic log, and the last remaining variable of Equation 1 may be calculated.

Determining the acoustic slowness of the fluid within the pore space may include determining the acoustic slowness at one or more subsurface intervals within the pore space at the geological area of interest. Accordingly, the method 100 may determine acoustic slowness for some or all of the subsurface intervals in a geological formation or well therein.

Figure 3A:
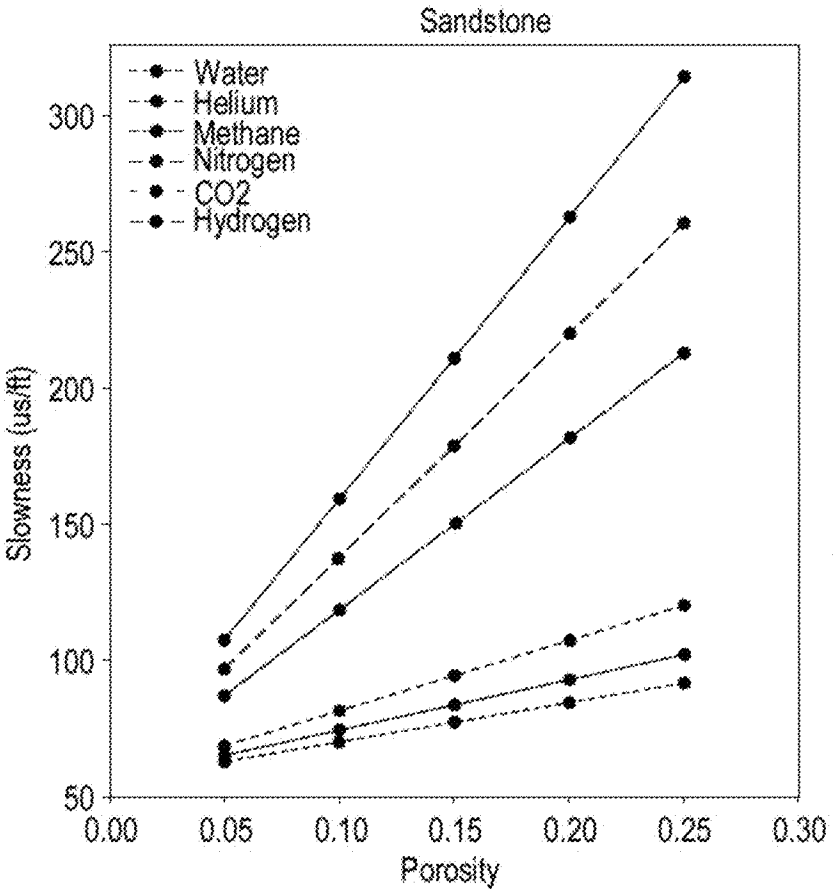
FIGS. 3A and 3B are graphical reproductions of acoustic log responses for different endmember gases across a range of porosities for an assumed sandstone and gabbro matrix, respectively.
Figure 3B:
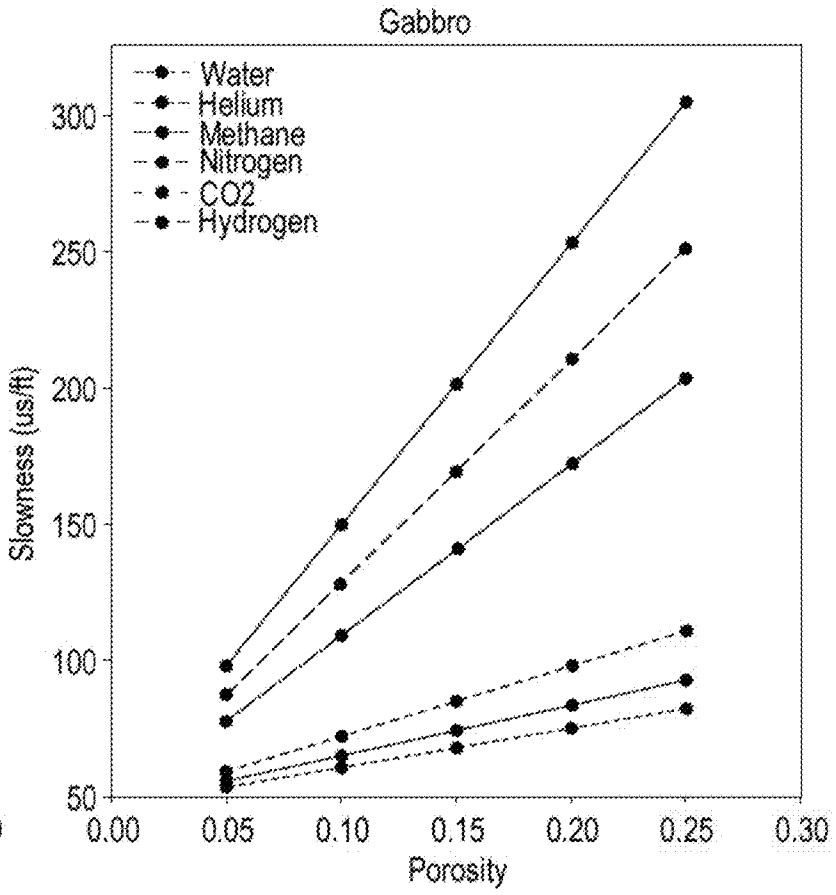

FIGS. 3A and 3B are graphical reproductions of acoustic log responses (e.g., acoustic slowness) for different endmember gases across a range of porosities for an assumed sandstone and gabbro matrix, respectively. More specifically, FIGS. 3A and 3B are graphical reproductions of the calculated outputs following Equation 1 and inputs in Tables 1-3. The acoustic response outputs are calculated across porosities ranging from 5% to 25% filled with varying proportions of water, hydrogen, helium, methane, nitrogen, and carbon dioxide. As shown, hydrogen or helium may be easily distinguished from methane, nitrogen, or carbon dioxide in the gaseous or super-critical form.

The determined fluid densities and acoustic slownesses corresponding to one or more subsurface intervals may be used to determine or identify the fluid type(s) within the pore space at the one or more subsurface intervals in a geological area of interest.

Determining a fluid type within the pore space at block 170 may include determining the fluid type(s) within the pore space at the one or more subsurface intervals. Determining a fluid type within the pore space at block 170 may include determining the fluid type(s) based on the determined fluid density and acoustic slowness of the fluid(s). Determining a fluid type within the pore space at block 170 may include comparing bulk fluid density values and acoustic slowness values for corresponding rock matrices (e.g., rock matrix type(s) and porosity(s)) with known bulk fluid density values and acoustic slowness values corresponding to known fluids and corresponding amounts thereof. In such examples, the fluid type(s) are readily identified and the relative amounts thereof are also identified.

The calculated value of the fluid density and acoustic slowness in a subsurface interval may be used to identify the fluid type(s) therein. Determining a fluid type within the pore space of the rock formation may include correlating the fluid density and acoustic slowness of the fluid within pore space of the rock formation to a known combination of fluid density and acoustic slowness of one or more of hydrogen, methane, hydrogen, helium, water, or carbon dioxide. For example, if the calculated acoustic slowness value is less than 250 μs/ft, then the fluid is identified as water if the calculated fluid density is close to 1.00 g/cm$^3$ (e.g., 0.9 to 1.2 g/cm$^3$) or as hydrogen if the fluid density is less than 1.00 g/cm$^3$ by one or more orders of magnitude. If the calculated acoustic slowness is in the range of 500-750 μs/ft, and the density is much less than 1.00 g/cm$^3$, then the fluid is identified as methane. If the calculated acoustic slowness is in the range of 750-1,000 μs/ft, and the density is much less than 1.00 g/cm$^3$, such as less than 0.8 g/cm$^3$, the fluid is identified as nitrogen. If the calculated acoustic slowness is greater than 1,000 μs/ft, the fluid is identified as carbon dioxide.

One fluid may be differentiated from other fluid(s) by examining both the determined fluid density and acoustic slowness of the fluid(s) in the pore space compared to the fluid density and acoustic slowness other known fluids, such as those found in similar rock matrix types. For example, relatively larger amounts (e.g., at least 20% by volume of the rock formation) hydrogen, methane, and carbon dioxide in the rock formation may be differentiated from water and relatively lower amounts (e.g., 10% or less by volume of the rock formation) of hydrogen, methane, and carbon dioxide by identifying bulk densities of less than 2.2 g/cm$^3$. Similarly, hydrogen, methane, and carbon dioxide in relatively high amounts within a sandstone rock formation may be differentiated from each other in by comparing the acoustic slowness of the respective fluids. For example, for sandstone with 20% porosity filled with hydrogen has an acoustic slowness value of about 90 μs/ft, filled with methane has an acoustic slowness value of about 180 μs/ft, and filled with carbon dioxide has an acoustic slowness value of about 260 μs/ft. Comparing a determined bulk density in the rock formation to known bulk densities may aid in differentiated fluids such as hydrogen, helium, methane, and carbon dioxide from hydrocarbons, water, and other fluid mixtures in the rock formation; and comparing determined acoustic slowness of the fluids within the rock formation aids in further differentiating fluids from each other such as hydrogen, methane, and carbon dioxide from each other and other fluids.

Figure 4:
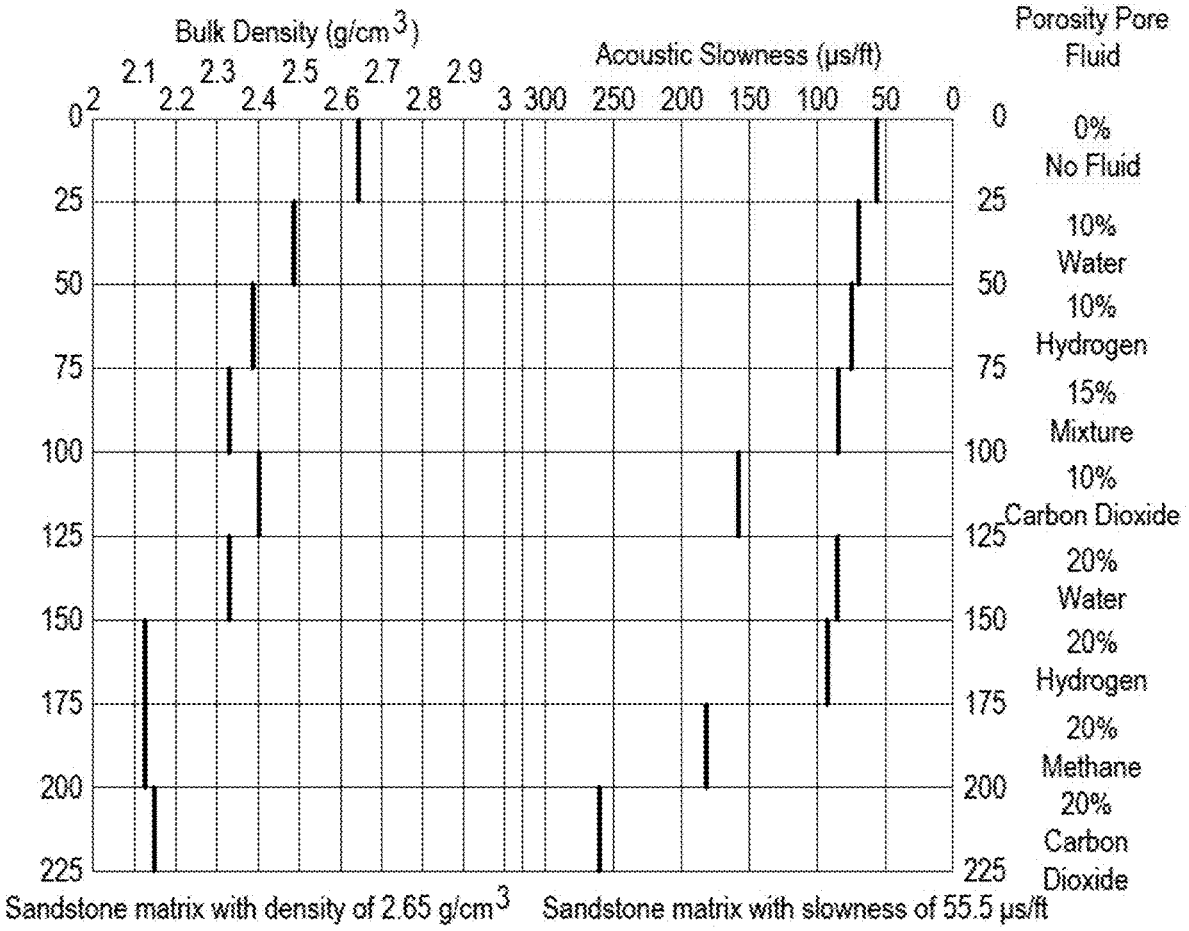
FIG. 4 is a Synthetic Log demonstrating bulk density and acoustic slowness response across variable porosities and fluid compositions, according to an embodiment.

FIG. 4 is a Synthetic Log demonstrating bulk density and acoustic slowness response across variable porosities and fluid compositions, according to an embodiment. Specifically, FIG. 4 depicts hypothetical synthetic geophysical log data that shows the different log responses for a hypothetical sequence of twenty-five feet thick sections of sandstone with 0% porosity, 10% porosity filled with water, 10% porosity filled with hydrogen, 15% porosity filled with a mixture of fluids (18% methane, 1% carbon dioxide, 26.5% hydrogen, 49.5% water, 4.5% helium, and 0.5% nitrogen), 10% porosity filled with carbon dioxide, 20% porosity filled with water, 20% porosity filled with hydrogen, 20% porosity filled with methane, and 20% porosity filled with carbon dioxide. Hydrogen-filled, helium-filled, or carbon dioxide-filled pore space may be distinguished from water, methane, or other gases by combining density and sonic geophysical logs.

The sections of rock with hydrogen-filled or helium-filled pores are differentiated from the same porosity rock filled with water or methane due to the relatively low fluid density of the hydrogen and helium combined with the intermediate interval transit time of hydrogen or helium. For a sandstone with 20% porosity, water-filled pores result in a density of 2.32 g/cm$^3$ and interval transit time of 84 μs/ft, whereas hydrogen-filled pores result in a density of 2.12 g/cm$^3$ and interval transit time of 92 μs/ft. Methane-filled and helium-filled pores, in this scenario, result in nearly identical densities as hydrogen-filled, at about 2.12 g/cm$^3$, but may be distinguished by interval transit times of 181 μs/ft for methane and 107 μs/ft for helium. Carbon dioxide-filled pores would result in a density of 2.15 g/cm$^3$, not quite as low as methane or hydrogen-filled pores, and a much higher interval transit time of 262 μs/ft. Instead, if the hydrogen is contained within a basalt with 8% porosity, the corresponding density and slowness values for basalt listed in Tables 1 and 2 indicate that for hydrogen-filled pores, a density of 2.44 g/cm$^3$ and an interval transit time of 67 μs/ft would be expected. In contrast, the same pores filled with water would result in a density of 2.52 g/cm$^3$ and an interval transit time of 63 μs/ft. Accordingly, a relatively low fluid density and a relatively high acoustic slowness value (compared to other samples in a subsurface interval) indicate hydrogen or helium in the pore space of a rock formation.

Based on the techniques disclosed above, fluids such as hydrogen, helium, carbon dioxide, methane, or the like may be differentiated from other subsurface fluids using geophysical density logs, geophysical acoustic logs, mud logs, etc. to determine the fluid densities and corresponding acoustic slownesses of the fluids in the pore space of a rock formation as set forth above. For example, hydrogen may be differentiated from one or more of nitrogen, carbon dioxide, water, or hydrocarbon fluids by comparing the determined fluid density and acoustic slowness of hydrogen with the fluid density and acoustic slowness of nitrogen, carbon dioxide, water, or hydrocarbons (e.g., methane, crude oil, or the like). A difference therebetween demonstrates a difference in fluid types. Carbon dioxide may be differentiated from one or more of nitrogen, hydrogen, water, or hydrocarbon fluids by comparing the determined fluid density and acoustic slowness of carbon dioxide with the fluid density and acoustic slowness of nitrogen, hydrogen, water, or hydrocarbons. Helium may be differentiated from one or more of nitrogen, carbon dioxide, hydrogen, water, or hydrocarbon fluids by comparing the determined fluid density and acoustic slowness of helium with the fluid density and acoustic slowness of nitrogen, carbon dioxide, hydrogen, water, or hydrocarbons. Methane may be differentiated from one or more of nitrogen, carbon dioxide, hydrogen, water, or other hydrocarbon fluids by comparing the determined fluid density and acoustic slowness of the methane with the fluid density and acoustic slowness of nitrogen, hydrogen, water, or hydrocarbons (e.g., methane, crude oil, or the like).

The multi-step comparison of the fluid density and the acoustic slowness of the fluids within the well with known fluid density and the acoustic slowness of various fluids may be used to determine the fluid type by differentiation. For example, at one or more points during the differentiation, the identity of the fluid in the pore space may not be known, but may be determined by direct comparison of the determined fluid density and acoustic slowness of the fluid in the pore space with known values for various fluids in similar or identical rock formations. A correspondence therebetween indicates the likelihood of a match between the determined fluid properties and a selected fluid type. The lack of a correspondence between the determined properties of the fluid and the acoustic slowness and fluid density of the known fluids may serve to eliminate some fluid types as the unknown fluid type.

Flagging determinations of selected fluid types at block 180 includes outputting an indication of the fluid(s) in the pore space. For example, flagging selected fluid types at block 180 includes flagging the one or more selected types of fluids from the determined fluid types, such as hydrogen, helium, carbon dioxide, methane, or the like. A computer program may flag identified hydrogen, methane, carbon dioxide or the like on each well log dataset as an output. The flags may include an electronic output of a fluid type at a corresponding depth and location of the geological area of interest. Such flags may be output as a list of fluid(s) and corresponding depths within a geological area of interest, such as in text form or on a well log. The flags may indicate an amount of the identified fluid(s) at one or more subsurface intervals at the geological area of interest.

The method 100 may include outputting the flags, such as on a list of determined fluids and corresponding subsurface intervals at one or more geological areas of interest, such as a well or field of wells. The flags may be output as a list, a map, or any other digital presentation. The flags may be output as data on well logs with the corresponding data.

The method 100 may include acquisition of data logs, such as accessing digital or electronically stored geophysical well logs. The method 100 may include acquiring data of physical characteristics of a well from of well logs, such as accessing and reading one or more of rock matrix type, bulk acoustic slowness, porosity, or the like from one or more well logs (e.g., geophysical well log). The numerical log data provides information on one or more variables useful in Equations 1-3 for one or more subsurface intervals at a geological area of interest. The method 100 may include digitizing paper well logs and performing image analysis on the digitized paper well logs to obtain numerical log data.

In some examples, if the porosity and rock matrix types or rock formations are known, the method 100 may start at block 150. In some examples, if the fluid density or acoustic slowness is known for the one or more subsurface intervals, then blocks 150 or 160 may be omitted from the method 100.

The ability to differentiate fluid types in porous subsurface formations allows for the identification and exploration of selected fluids (e.g., hydrogen, helium, or carbon dioxide) in the subsurface. The techniques described herein may be used in conjunction with the many thousands of geophysical well logs available through public and proprietary databases in the United States and even more globally to identify subsurface hydrogen, helium, or carbon dioxide resources and/or the identify subsurface hydrogen or carbon dioxide storage reservoirs or adjacent formations. These geophysical log or other wireline log data may be used also quantify and verify subsurface hydrogen, helium, or carbon dioxide storage or carbon sequestration by carbon mineralization in the subsurface. Longitudinal (over time or time series) collection of these geophysical log or other wireline log data may be used to further quantify and verify subsurface hydrogen, helium, or carbon dioxide storage or carbon sequestration by carbon mineralization in the subsurface. For example, data from the longitudinal collection of logs may be compared to determine relative differences between the carbon dioxide and hydrogen or helium content over time, such as to determine sequestration or depletion of fluids within a formation. Such techniques may be used to monitor injection of the fluid(s) into the formation.

The method 600 may include drilling one or more wells based upon the determined indication of the presence, absence, or amount of selected subsurface fluid(s) produced from the method 600. Examples of drilling are explained in more detail below. Such drilling may be for injection of fluids or gases into a rock formation or extraction of the selected fluid(s) from the formation. For example, the drilling may be carried out to extract hydrogen based on the determined presence of a subsurface hydrogen reservoir at one or more subsurface intervals from the method 600. The method 600 may include injecting fluid(s) into the subsurface intervals of interest (e.g., for sequestering, storing, or fracturing) or extracting fluid(s) from the subsurface intervals of interest.

As described in more detail below, during the exploration for hydrogen, helium, carbon dioxide, or other gases, a computer-assisted algorithm may be used to search through geophysical well log data and solve for fluid types utilizing the techniques and formulas disclosed herein. The computer assisted algorithm may be used in the identification of subsurface lithological formations that contain hydrogen, helium carbon dioxide, or other gases in the subsurface. Any portions of the method 100, such as blocks 110-180, may be carried out by a computing device (e.g., computer) as an algorithm stored therein. For example, the calculations of fluid density and fluid slowness at blocks 150 and 160 may be carried out on a computer for depth on a well log for the geological area of interest.

Figure 5:
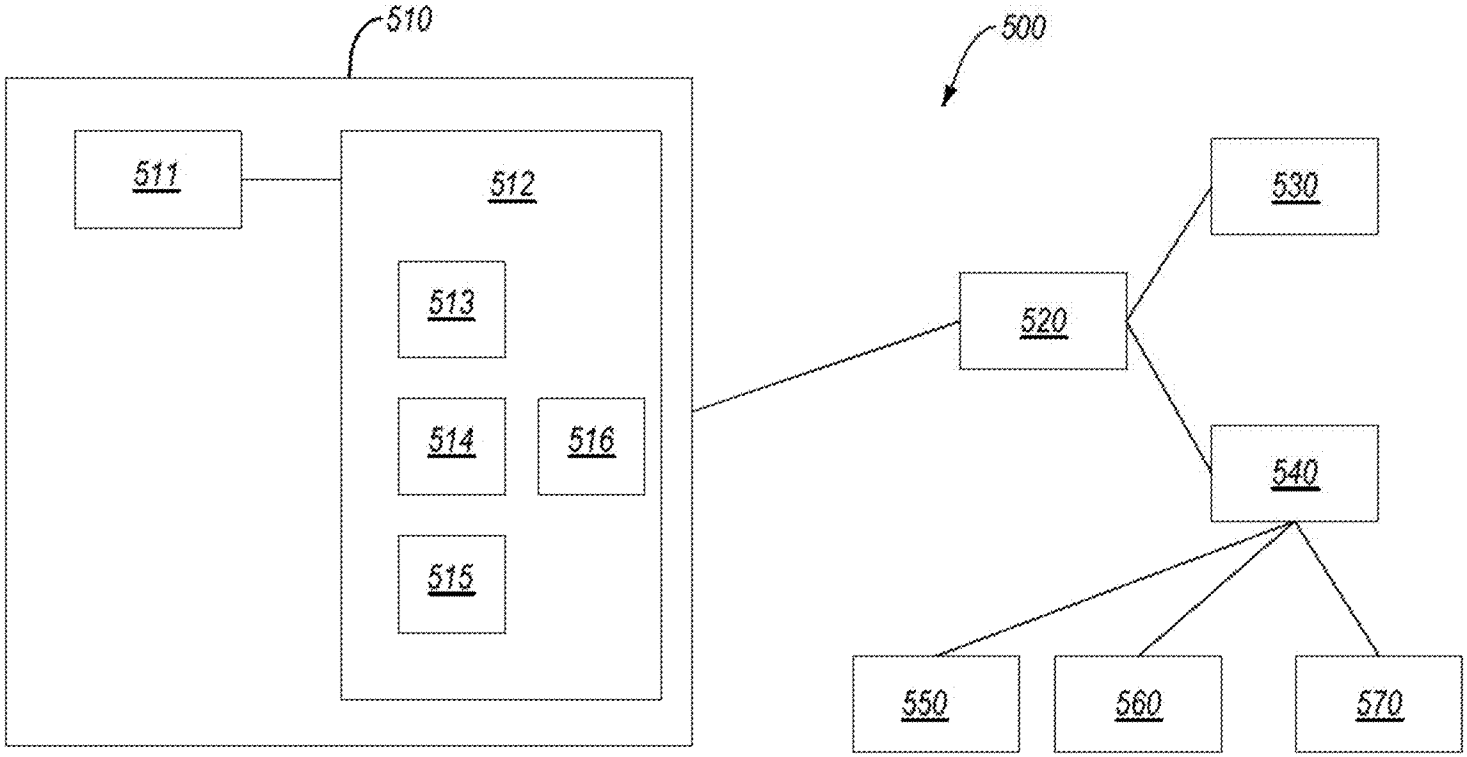
FIG. 5 is a block diagram of a system 500 for implementing the methods disclosed herein, according to an embodiment.

FIG. 5 is a block diagram of a system 500 for implementing the methods disclosed herein, according to an embodiment. The system 500 is a targeting system for targeting (e.g., identifying and quantifying) selected fluids within rock formations, such as hydrogen, helium, carbon dioxide, methane, or the like. The system 500 includes a computing device 510 having at least one processor 511 and a memory storage 512 storing data and one or more operational programs thereon. The memory storage 512 (e.g., a non-transitory memory storage medium) is in electronic communication with the processor 511 in electronic communication. The system 500 includes a communication network 520 in electronic communication with the computing device 510. The system 500 may include image logs 530 and numerical log data 540 obtained from digitization of paper well logs 550, digitized well logs 560, or drill site logging equipment 570. The image logs 530 and numerical log data 540 may be obtained via the communication network 520.

The at least one computing device 510 may include one or more servers, one or more computers (e.g., desk-top computer, lap-top computer), or one or more mobile computing devices (e.g., smartphone, tablet, etc.). The processor 511 of the computing device 510 includes hardware for executing instructions (e.g., instructions for carrying out one or more portions of any of the methods disclosed herein), such as those making up an operational program. The processor 511 is configured to read and execute operational programs stored in the memory storage 512.

The memory storage 512 of the computing device may include one or more of volatile and non-volatile memories, such as Random Access Memory (RAM), Read Only Memory (ROM), a solid state disk (SSD), Flash, Phase Change Memory (PCM), or other types of data storage. The memory storage 512 may be internal or distributed memory. The one or more operational programs stored in the memory storage 512 may include machine readable and executable instructions for performing any of the portions of the methods disclosed herein. For example, the one or more operational programs may include an image analysis engine 513, a numerical digital analysis engine 514, a relevance determination engine 515, or the like. The memory storage 512 also has a data store 516 therein for storing one or more sets of data, outputs of the methods disclosed herein, or any other digital information used in the methods disclosed herein.

For example, the data store 516 may contain imported well logs (e.g., electronic data logs or image logs) having numerical or other data for use by the analysis and determination engines.

The image analysis engine 513, numerical digital analysis engine 514, and a relevance determination engine 515 may be stored in the memory storage 512 as operational programs with instructions to carry out the computational and analysis techniques disclosed herein. The memory storage may contain a data store of imported well logs (e.g., electronic data logs or image logs) having numerical or other data for use by the analysis and determination engines.

The computing device 510 may include input/output ("I/O") device/interface (not shown). One or more I/O devices/interfaces, are configured and provided to allow a user to provide input to, receive output from, and otherwise transfer data to and from the computing device 510. These I/O devices/interfaces may include a mouse, keypad or a keyboard, a touch screen, camera, optical scanner, network interface, web-based access, modem, a port, other known I/O devices or a combination of such I/O devices/interfaces. The touch screen may be activated with a stylus or a finger.

The I/O devices/interfaces may include one or more devices for presenting output to a user, including, but not limited to, a graphics engine, a display (e.g., a display screen or monitor), one or more output drivers (e.g., display drivers), one or more audio speakers, and one or more audio drivers. In examples, I/O devices/interfaces are configured to provide graphical data to a display for presentation to a user. The graphical data may be representative of one or more graphical user interfaces and/or any other graphical content as may serve a particular implementation.

The computing device 510 may further include a communication interface (not shown). The communication interface may include hardware, software, or both. The communication interface may provide one or more interfaces for communication (such as, for example, packet-based communication) between the computing device 510 and one or more additional computing devices or one or more networks. For example, communication interface may include a network interface controller (NIC) or network adapter for communicating with an Ethernet or other wire-based network or a wireless NIC (WNIC) or wireless adapter for communicating with a wireless network, such as a WI-FI network.

Any suitable network and any suitable communication interface may be used. For example, computing device 510 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, one or more portions of the computing device 510 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination thereof. Computing device 510 may include any suitable communication interface for any of these networks, where appropriate.

The computing device 510 may include a bus (not shown). The bus may include hardware, software, or both that couples components of computing device 510 to each other. For example, bus may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination thereof.

The communication network 520 may include an information system enabling electronic transfer or data between remote sources, such as the world wide web, a local wireless network, a local area network, or the like. The communication network 520 may include one or more cloud-based components. The computing device 510 is in electronic communication with remote image logs 530 and numeric log data 540, such as via the communication network 520 (e.g., internet connection, ethernet connection, or local area network).

The numeric log data 540 may be provided from digitization of existing paper logs 550, acquisition of existing digitized logs 560, or from an on-site logging system 570 (e.g., logging truck at drill site). The numeric (well) log data 540 and image log data 530 may be accessed and used by the computing device 510 to perform any portions of the methods disclosed herein. For example, the numeric log data 540 and image log data 530 may be downloaded and stored in the data store 516 to be used by one or more of the image analysis engine 513, numerical digital analysis engine 514, or relevance determination engine 515 to identify and quantify selected fluid types within a rock formation at a geographical area of interest.

The image analysis engine 513 may analyze images of well logs to identify and record information therein. For example, the image analysis engine 513 may examine digitized images of paper well logs to identify and record characteristics of the rock formation and fluid(s) therein, such as resistivity, neutron porosity, rock types, bulk density, etc., in electronic form.

Figure 6:
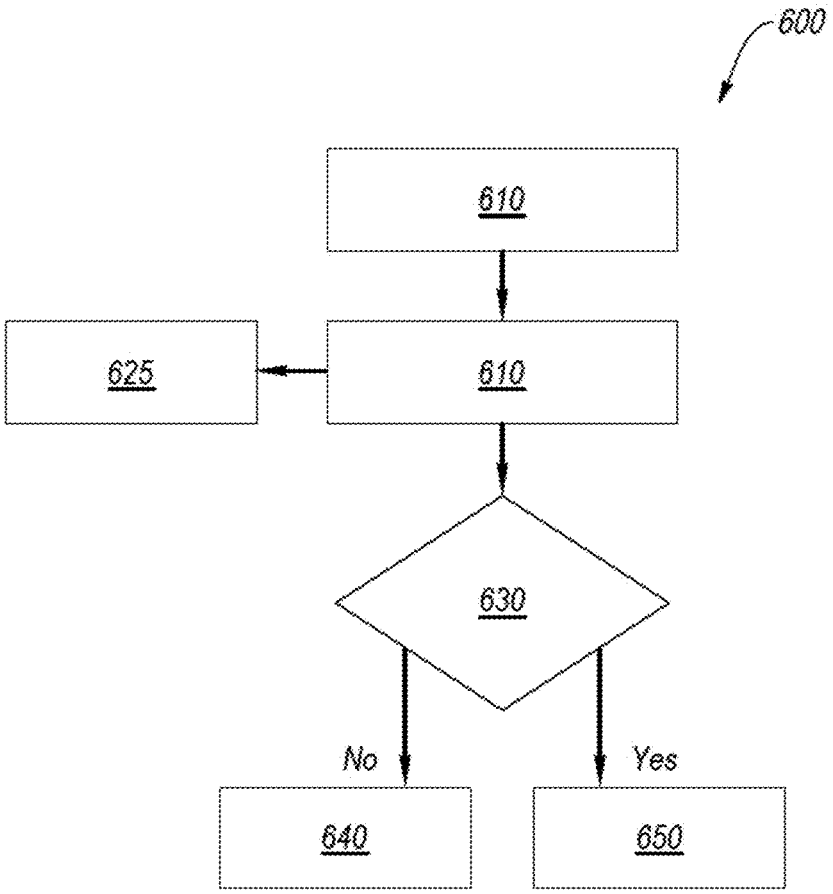
FIG. 6 is a block diagram of a method for image analysis 600, according to an embodiment.

FIG. 6 is a block diagram of a method for image analysis 600, according to an embodiment. The image analysis method 600 may be carried out on the computing device 510 disclosed above. The image analysis method 600 includes receiving information on imaged or digitized well logs at block 610; estimating the likelihood that the well log characteristics are indicative of selected fluid (e.g., hydrogen, helium, or carbon dioxide) accumulations at block 620; and determining if the estimated likelihood satisfies a predetermined threshold for likelihood of the presence of selected fluid accumulations at block 630. And responsive to determining if the estimated likelihood satisfies a predetermined threshold, the image analysis method 600 includes outputting an indication that the well log characteristics are or are not indicative of the presence of selected fluid accumulations at blocks 650 and 640 respectively. The image analysis method 600 includes outputting the probability or confidence that the characteristics are indicative of the presence of the selected fluid at block 625.

Receiving information on imaged or digitized well logs at block 610 may include receiving the information (e.g., well log data or images) on a computing device. The information may include images or well logs or data from digitized well logs indicating characteristics of rock matrices at one or more subsurface intervals at one or more geological areas of interest. The imaged or digitized well logs may include any of the logs disclosed herein, such as a plurality of well logs each providing different characteristics.

Estimating the likelihood that the well log characteristics are indicative of selected fluid accumulations at block 620 may include carrying out one or more portions of the method 100 (FIG. 1). The estimated likelihood that the well log characteristics are indicative of selected fluid accumulations may include a binary, yes or no, indication that the selected fluid accumulation is present. In some examples, the estimated likelihood that the well log characteristics are indicative of selected fluid accumulations may include a selected number of indications within a single geological area of interest, indications of the presence of selected fluid(s) in a selected number of subsurface intervals, a selected quantity of the selected fluid(s), or combinations of the foregoing, determined using any of the methods disclosed herein.

In some examples, the estimated likelihood may be expressed as a probability or confidence interval that the characteristics are indicative of the presence of the selected fluid. The probability or confidence interval may be based on a statistically acceptable deviation of the calculated amount of fluid(s) from a target value (e.g., within 10%, or at least 90% of the target value). Accordingly, the probability or confidence interval may be expressed as a percentage or fraction of the target value.

Outputting the probability or confidence that the characteristics are indicative of the presence of the selected fluid at block 625 may include outputting an indication of the presence of the selected fluid(s) at one or more subsurface intervals at one or more geographical areas of interest, in digital form on one or more of well logs, maps, or lists. The selected fluid of interest may include hydrogen, helium, methane, carbon dioxide, or any other fluid(s). For example, the image analysis method 600 may include outputting the probability of confidence that the characteristics are indicative of the presence of hydrogen, helium, or carbon dioxide. The output may be sent to the memory storage of the computing device for compilation in a report or correlation with the image or location corresponding to the image. The output may be sent to a remote computing device.

Determining if the estimated likelihood satisfies a predetermined threshold for likelihood of the presence of selected fluid accumulations at block 630 may include comparing the determined indications within a single geological area of interest, determined indications of the presence of selected fluid(s) in a selected number of subsurface intervals, determined quantity of the selected fluid(s), or combinations of the foregoing meet or exceed threshold values for the same. The threshold values may be entered into the image analysis engine 513. The threshold values may be based on values indicating a profitable reservoir of the selected fluid based on one or more considerations, such as depth, drilling costs, pumping costs, or the like.

Responsive to determining if the estimated likelihood satisfies a predetermined threshold, the method 600 includes outputting an indication that the well log characteristics are not indicative of the presence of selected fluid accumulations 640 or outputting an indication that the well log characteristics are indicative of the presence of selected fluid accumulations 640. The output may be sent to the memory storage of the computing device for compilation in a report or correlation with the image or location corresponding to the image. The output may be sent to a remote computing device.

In some examples, the image analysis method may be more simplified, including receiving the well log image; analyzing the well log image and determining the presence of log characteristics consistent with a selected subsurface fluid; and outputting a result of the analysis as raw data. Such analysis may include any portions of the method 100 and 600 and the output may include outputting a report of the analysis results. The output may be in the form of a map, well logs, or a report listing the results of the analysis, such as providing information on the location, depth, and amount of the selected fluids in the geological area of interest.

The image analysis methods disclosed herein may be implemented in whole or in part in the image analysis engine 513 stored in the computing device 510.

In some examples, the image analysis engine may be implemented as an artificial intelligence program. The artificial intelligence program may be trained according to classify images of geophysical well logs, according to an embodiment. The training algorithm includes a first step of receiving a training dataset of labeled images illustrating well log-based features consistent with selected subsurface fluid(s) (e.g., hydrogen, helium, carbon dioxide, methane, mixed hydrocarbons, or mixtures thereof) accumulations, a second step of training an image classification module using the training data set, and a third step of hosting the image classification model by the image analysis engine.

The model may be built by a model generator, such as according to the image training data set and Equations 1-2 (e.g., ensuring the model built based on the training images complies with the method 100 and Equations 1-2, where applicable). Training an image classification module using the training data set may include ensuring the image classification module utilizes one or more portions of the method 100 or 600. For example, the image classification module may operate according to Equations 1-2 as used in the method 100.

Returning to FIG. 5, the numerical digital analysis engine 514 may include machine readable and executable instructions to operate similarly or identical to one or more portions of the method 100 using data obtained from numerical log data 540. The output of the numerical analysis engine 514 may be similar or identical to the outputs of the image analysis engine 513 in one or more aspects.

The relevance determination engine 515 may include machine readable and executable instructions to determine the relevance of determined characteristics of fluid(s) within one or more subsurface intervals at a geographical area of interest to a selected criteria, such as selected fluid type, amount of selected fluid type, number and/or locations of subsurface intervals including the selected fluid type and amount thereof, or the like. Accordingly, the relevance determination engine 515 may determine if the fluid(s) in a subsurface formation indicate the presence of a reservoir of the selected fluid(s) large enough to be of interest to extractors, indicate the amount of depletion or sequestration of the selected fluid(s) in the subsurface formation, or the like.

The output of the relevance determination engine 515 may be similar or identical to the outputs of the image analysis engine 513 in one or more aspects.

In some examples, one or more of the image analysis engine 513, numerical digital analysis engine 514, and relevance determination engine 515 may be omitted from the system 500.

Any portions of the methods 100, 600, image analysis engine 513, numerical digital analysis engine 514, or relevance determination engine 515 may form discrete portions of software to identify and quantify selected fluid types within a rock formation at a geographical area of interest.

The following examples are provided to illustrate various embodiments of the methods, components of the methods, systems, components of the systems, applications and materials disclosed herein. These examples are for illustrative purposes and should not be viewed as limiting, and do not otherwise limit, the scope of the claims.

PROPHETIC EXAMPLES

Figure 7A:
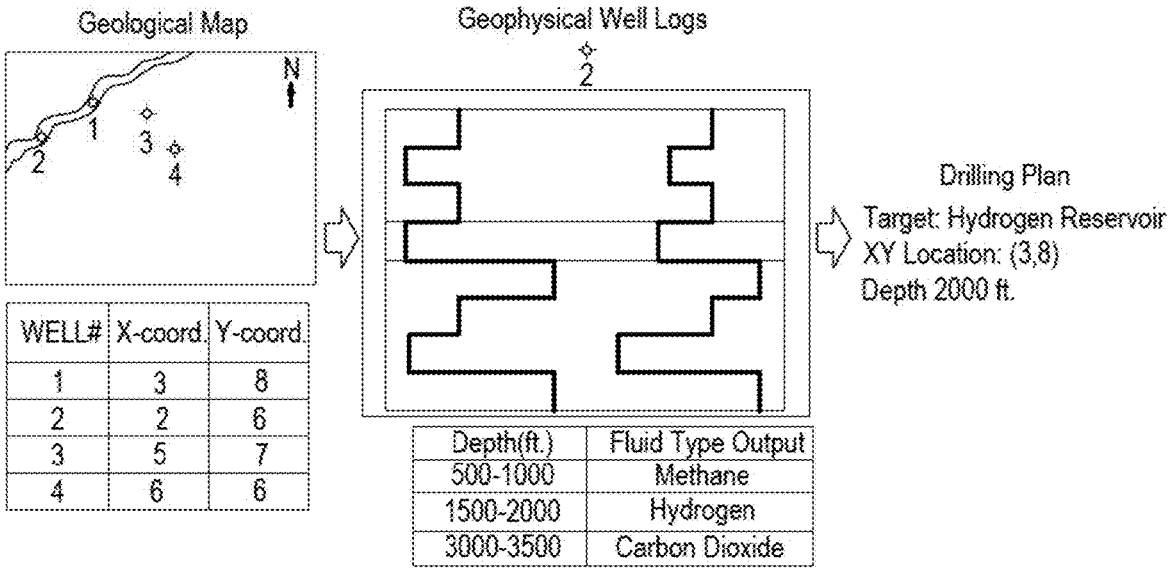
FIGS. 7A and 7B are flow diagrams of analyses of a geological map and corresponding well logs, according to embodiments.
Figure 7B:
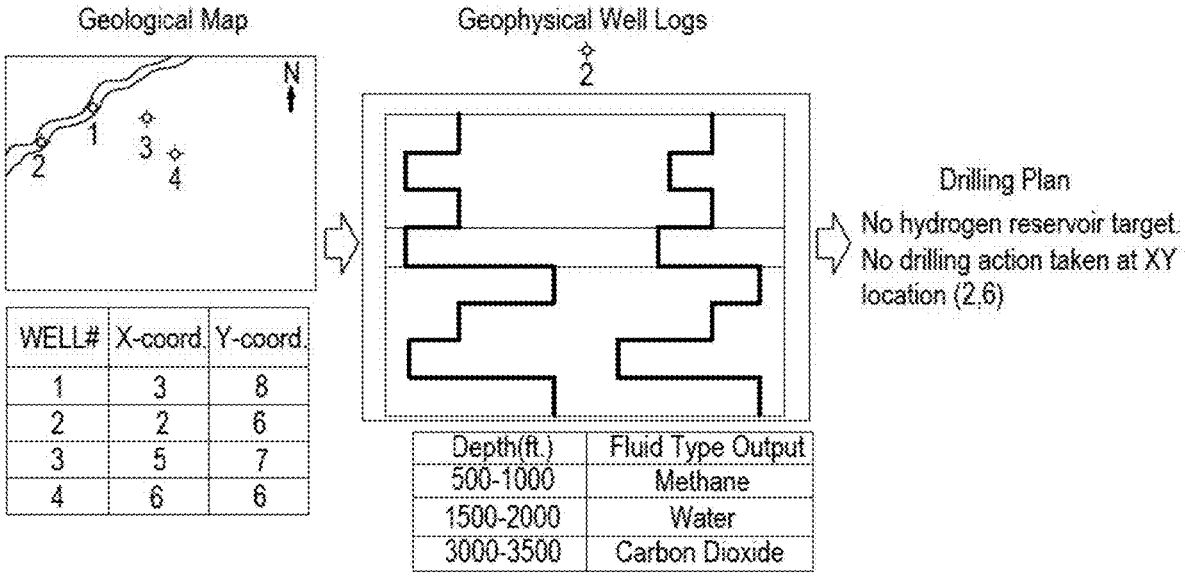

FIGS. 7A and 7B are flow diagrams of analyses of a geological map and corresponding well logs, according to embodiments. FIGS. 7A and 7B show how the techniques to determine the presence of selected subsurface fluids disclosed herein are utilized for well planning and drilling. A geological map 710 shows the location of igneous rock 712 (e.g., granite, basalt, or gabbro) in a geological area of interest. Igneous rocks are potential source rocks for hydrogen generation in the subsurface. The geological map 710 shows the location of wells 701, 702, 703, and 704 previously drilled in the area.

Wells 701 and 702 may become the wells of interest due to their location on the mapped igneous rock. In response thereto, well logs for wells 701 and 702 may be evaluated using the techniques disclosed herein.

In FIG. 7A, the well logs corresponding to well 701 are analyzed using the method 100 (FIG. 1). The outputs of the method 100 for three different intervals of well 701 show sandstone reservoirs at 500-1,000 ft, 1,500-2,000 ft, and 3,000-3,500 ft, filled with methane, hydrogen, and carbon dioxide, respectively. The sandstone reservoir filled with hydrogen at 1,500-2,000 ft becomes the drilling target of interest. A drilling plan is then developed to drill a new well at or near the location of well 701 with a target depth of 2,000 ft.

In FIG. 7B, the well logs corresponding to well 702 are analyzed using the method 100 (FIG. 1). The outputs of the method 100 for three different intervals of well 702 show sandstone reservoirs at 500-1,000 ft, 1,500-2,000 ft, and 3,000-3,500 ft, filled with methane, water, and carbon dioxide, respectively. No action would be taken at this location to drill for a hydrogen reservoir.

WORKING EXAMPLES

Figure 8:
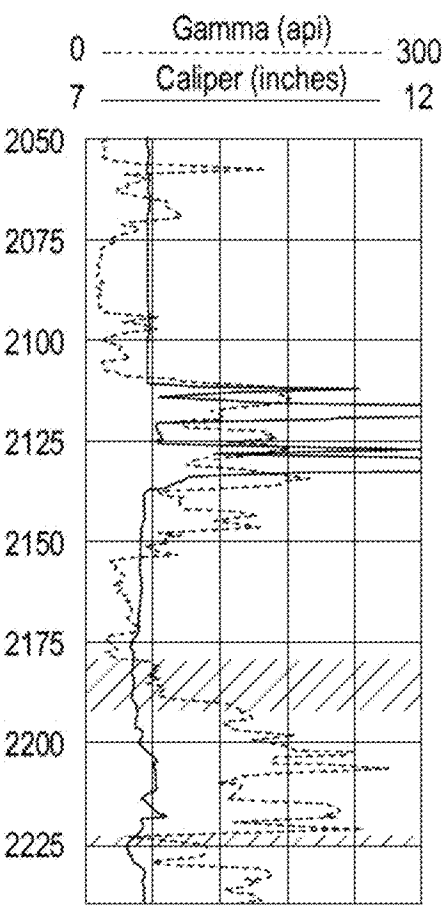
FIG. 8 is a display of wireline log data depicting the gamma ray readings and caliper readings from a well.

FIG. 8 is a display of wireline log data depicting the gamma ray readings (API) and caliper readings from a well. The information in FIG. 8 shows the rock type based on the gamma ray readings and caliper readings. The readings in the hatched area demonstrate the rock type is sandstone at the corresponding subsurface intervals. The sandstone rock type was used to determine the fluid density and acoustic slowness as set forth in the method 100.

Figure 9:
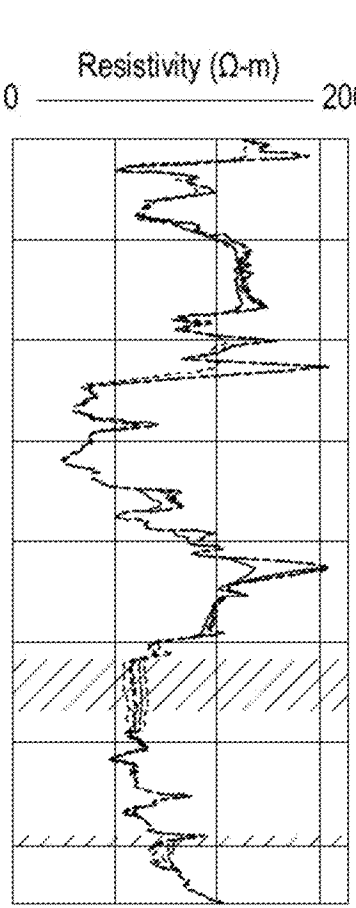
FIG. 9 is a display of wireline log data depicting resistivity readings from the well of FIG. 8.
Figure 9:
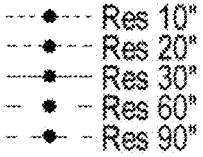

FIG. 9 is a display of wireline log data depicting resistivity readings from the well of FIG. 8. The resistivity readings in FIG. 12 was used to determine the porosity of the rock formation in the well and the fluid types therein. The readings in the hatched area demonstrate the hydrogen is present at the corresponding subsurface intervals. For example, the resistivity was used to calculate the fluid density and acoustic slowness of the fluid(s) as set forth in the method 100.

Figure 10:
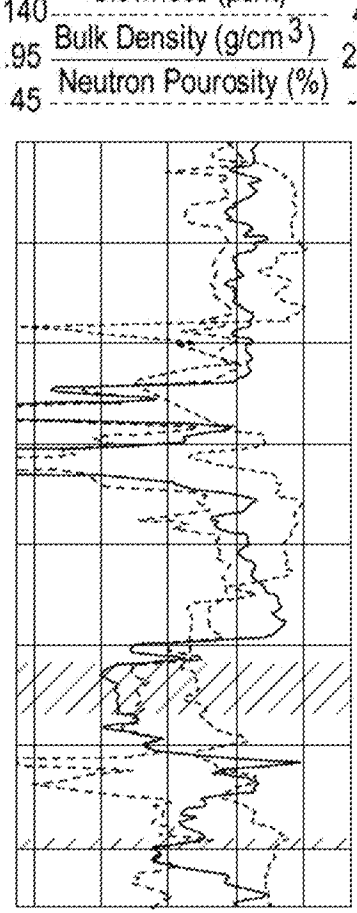
FIG. 10 is a display of wireline log data depicting slowness, bulk density, and neutron porosity readings from the well of FIG. 8.

FIG. 10 is a display of wireline log data depicting slowness, bulk density, and neutron porosity readings from the well of FIG. 8. The slowness readings (μs/ft), bulk density readings (g/cm$^3$), and neutron porosity readings (%) in FIG. 10 were used to determine the fluid density and acoustic slowness of the fluids therein. The readings in the hatched area demonstrate the hydrogen is present at the corresponding subsurface intervals. For example, the slowness (e.g., bulk slowness or $\Delta t_{log}$) was used to determine the acoustic slowness of the fluid ($\Delta t_{fluid}$) as set forth in the method 100. The bulk density ($\rho_{log}$) and porosity ($\Phi$) were used to determine the fluid density ($\rho_{fluid}$) as set forth in the method 100.

Figure 11:
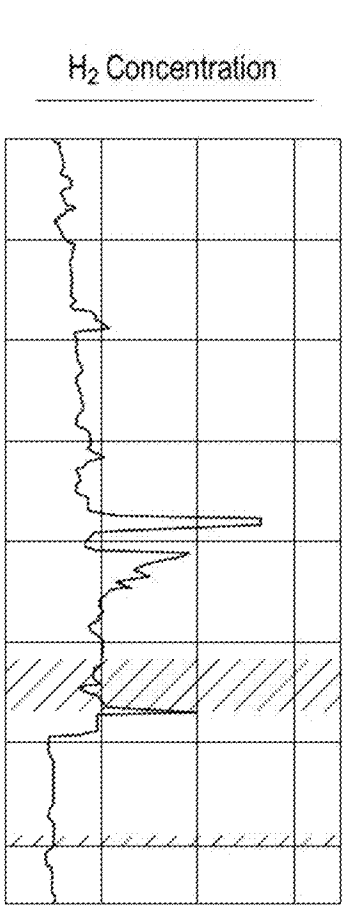
FIG. 11 is a mud gas mass spectrometry log from a recently drilled well targeting hydrogen-rich reservoirs of the well in FIG. 8.

FIG. 11 is a mud gas mass spectrometry log from a recently drilled well targeting hydrogen-rich reservoirs of the well in FIG. 8. The highlighted intervals, located within a sandstone, have density, porosity, and acoustic log values that indicate a mixture of water and hydrogen in the pore space based on the information in FIGS. 8-10. Notably, FIG. 11 shows there is a coincident increase above background in hydrogen in the mud gas stream at the same interval. Accordingly, hydrogen present in drilling mud confirms the determination of a hydrogen reservoir at a corresponding depth in the well.

FIG. 11 is a real-world example that confirms the methods, systems, and software disclosed herein may successfully identify selected fluids such as hydrogen within subsurface formations.

The methods, systems, and software disclosed herein may be used in any number of industries and applications. For example, the methods, systems, and software disclosed herein may be used to identify subsurface gas reservoirs, quantify an amount of gas therein, confirm gas sequestration in a subsurface reservoir, or confirm depletion of gas in a subsurface reservoir.

Although the present specification focuses on hydrogen, helium, and carbon dioxide, it is understood that the techniques disclosed herein are not so limited and may find application in the identification and quantitative assessment of other subsurface materials, including other gases, ore deposits, minerals and gems, as well as, materials found in large structures such as foundations, dams, hydroelectric facilities, and nuclear facilities to name a few.

In the production of natural resources from lithological formations within the earth, a well or borehole is drilled into the earth to the location where the natural resource is believed to be located. Similarly in the subsurface storage of gases or the sequestration of greenhouse gases in formations within the earth, a well or borehole is drilled into the earth to the location where the greenhouse gas will be injected, stored, located, or sequestered. These natural resources may be hydrogen; helium; carbon dioxide; methane or other hydrocarbon gases; a dihydrogen sulfide reservoir; a hydrogen reservoir; a helium reservoir; a carbon dioxide reservoir; a reservoir rich in dihydrogen sulfide; a reservoir rich in hydrocarbons; the natural resource may be fresh water; brackish water; brine; it may be a heat source for geothermal energy; or it may be some other natural resource, ore deposit, mineral, metal, or gem that is located within the ground.

These resource-containing formations may be a few hundred feet, a few thousand feet, or tens of thousands of feet below the surface of the earth, including under the floor of a body of water, e.g., below the sea floor or beneath other natural resources, e.g., below aquifers. In addition to being at various depths within the earth, these formations may cover areas of differing sizes, shapes, and volumes.

Typically, and by way of general illustration, in drilling a well an initial borehole is made into the earth, e.g., the surface of land or seabed, and then subsequent and smaller diameter boreholes are drilled to extend the overall depth of the borehole. In this manner as the overall borehole gets deeper its diameter becomes smaller; resulting in what may be envisioned as a telescoping assembly of holes with the largest diameter hole being at the top of the borehole closest to the surface of the earth.

Thus, by way of example, the starting phases of a subsea drill process may be explained in general as follows. Once the drilling rig is positioned on the surface of the water over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity are returned to the seafloor. Next, a 26" diameter borehole is drilled within the 30" casing, extending the depth of the borehole to about 1,000-1,500 ft. This drilling operation may also be conducted without using a riser. A 20" casing is then inserted into the 30" conductor and 26" borehole. This 20" casing is cemented into place. The 20" casing has a wellhead secured to it. (In other operations an additional smaller diameter borehole may be drilled, and a smaller diameter casing inserted into that borehole with the wellhead being secured to that smaller diameter casing.) A BOP (blow out preventer) is then secured to a riser and lowered by the riser to the sea floor; where the BOP is secured to the wellhead. From this point forward all drilling activity in the borehole takes place through the riser and the BOP.

It should be noted that riser-less subsea drilling operations are also contemplated.

For a land-based drill process, the steps are similar, although the large diameter tubulars, 30"-20" are typically not used. Thus, and generally, there is a surface casing that is typically about 13⅜" diameter. This may extend from the surface, e.g., wellhead and BOP, to depths of tens of feet to hundreds of feet. One of the purposes of the surface casing is to meet environmental concerns in protecting ground water and prevent surface casing ventflow of greenhouse gases, flammable gases, or salt-rich brines. The surface casing should have a sufficiently large diameter to allow the drill string, production equipment such as electronic submersible pumps (ESPs) and circulation mud to pass through. Below the casing one or more different diameter intermediate casings may be used. (It is understood that sections of a borehole may not be cased, which sections are referred to as open hole). These may have diameters in the range of about 7" to about 9", although larger and smaller sizes may be used, and may extend to depths of thousands and tens of thousands of feet. Inside of the casing and extending from a pay zone, or production zone of the borehole up to and through the wellhead on the surface is the production tubing. There may be a single production tubing or multiple production tubings in a single borehole, with each of the production tubing endings being at different depths.

Fluid communication between the formation and the well may be greatly increased by the use of hydraulic fracturing techniques. The first uses of hydraulic fracturing date back to the late 1940s and early 1950s. In general, hydraulic fracturing treatments involve forcing fluids down the well and into the formation, where the fluids enter the formation and crack, e.g., force the layers of rock to break apart or fracture. These fractures create channels or flow paths that may have cross sections of a few microns, to a few millimeters, to several millimeters in size, and potentially larger. The fractures may also extend out from the well in all directions for a few feet, several feet, and tens of feet or further. The fractures may be kept open by using a proppant (e.g., various sized sand grains) that is forced down the well with the fracturing fluid in a single operation. It should be remembered that the longitudinal axis of the well in the reservoir may not be vertical: it may be on an angle (either sloping up or down) or it may be horizontal. The section of the well located within the reservoir, i.e., the section of the formation containing the natural resources, may be called the pay zone; in other embodiments of gas storage these reservoir intervals where gases are injected may be the called the storage reservoir.

As used herein, unless specified otherwise, the terms "hydrogen exploration and production", "carbon dioxide exploration and production", "helium exploration and production", "dihydrogen sulfide exploration and production", "exploration and production activities", "E&P", and "E&P activities", and similar such terms are to be given their broadest possible meaning, and include surveying, geological analysis, well planning, reservoir planning, reservoir management, drilling a well, workover and completion activities, hydrogen or helium production, flowing of hydrogen or helium from a well, collection of hydrogen or helium, secondary and tertiary recovery from a well, the management of flowing hydrogen or helium from a well, injection or storage of hydrogen, helium, or carbon dioxide into the subsurface using a well or borehole, and any other upstream activities.

As used herein, unless specified otherwise, the term "earth" should be given its broadest possible meaning, and includes, the ground, all natural materials, such as rocks, and artificial materials, such as concrete, that are or may be found in the ground.

As used herein, unless specified otherwise "offshore" and "offshore drilling activities" and similar such terms are used in their broadest sense and would include drilling activities on, or in, any body of water, whether fresh or salt water, whether manmade or naturally occurring, such as for example rivers, lakes, canals, inland seas, oceans, seas, such as the North Sea, bays and gulfs, such as the Gulf of Mexico. As used herein, unless specified otherwise the term "offshore drilling rig" is to be given its broadest possible meaning and would include fixed towers, tenders, platforms, barges, jack-ups, floating platforms, drill ships, dynamically positioned drill ships, semi-submersibles and dynamically positioned semi-submersibles. As used herein, unless specified otherwise the term "seafloor" is to be given its broadest possible meaning and would include any surface of the earth that lies under, or is at the bottom of, any body of water, whether fresh or salt water, whether manmade or naturally occurring.

As used herein, unless specified otherwise, the term "borehole" should be given it broadest possible meaning and includes any opening that is created in the earth that is substantially longer than it is wide, such as a well, a well bore, a well hole, a micro hole, a slimhole and other terms commonly used or known in the arts to define these types of narrow long passages. Wells would further include exploratory, discovery, production, abandoned, reentered, reworked, recirculation, storage, and injection wells. They would include both cased and uncased wells, and sections of those wells. Uncased wells, or section of wells, also are called open holes, boreholes, open boreholes, open bores, or open hole sections. Boreholes may further have segments or sections that have different orientations, they may have straight sections and arcuate sections and combinations thereof. Thus, as used herein unless expressly provided otherwise, the "bottom" of a borehole, the "bottom surface" of the borehole and similar terms refer to the end of the borehole, i.e., that portion of the borehole furthest along the path of the borehole from the borehole's opening, the surface of the earth, or the borehole's beginning. The terms "side" and "wall" of a borehole should be given their broadest possible meaning and include the longitudinal surfaces of the borehole, whether or not casing or a liner is present, as such, these terms would include the sides of an open borehole or the sides of the casing that has been positioned within a borehole. Boreholes may be made up of a single passage, multiple passages, connected passages, (e.g., branched configuration, fishboned configuration, dual-lateral configuration, trilateral configuration, quadrilateral configuration, pitchfork configuration, pinnate configuration, or comb configuration), and combinations and variations thereof.

Boreholes are generally formed and advanced by using mechanical drilling equipment having a rotating drilling tool, e.g., a bit. For example, and in general, when creating a borehole in the earth, a drilling bit is extending to and into the earth and rotated to create a hole in the earth. To perform the drilling operation the bit must be forced against the material to be removed with a sufficient force to exceed the shear strength, compressive strength, or combinations thereof, of that material. The material that is cut from the earth is generally known as cuttings or drill cuttings, e.g., waste, which may be chips of rock, dust, rock fibers and other types of materials and structures that may be created by the bit's interactions with the earth. These cuttings are typically removed from the borehole by the use of fluids, which fluids may be liquids, foams or gases, or other materials know to the art.

As used herein, unless specified otherwise, the term "drill pipe" is to be given its broadest possible meaning and includes all forms of pipe used for drilling activities; and refers to a single section or piece of pipe. As used herein the terms "stand of drill pipe," "drill pipe stand," "stand of pipe," "stand," and similar type terms should be given their broadest possible meaning and include two, three, or four sections of drill pipe that have been connected, e.g., joined together, typically by joints having threaded connections. As used herein the terms "drill string," "string," "string of drill pipe," "string of pipe," and similar type terms should be given their broadest definition and would include a stand or stands joined together for the purpose of being employed in a borehole. Thus, a drill string could include many stands and many hundreds of sections of drill pipe.

As used herein, unless specified otherwise, the terms "formation," "reservoir," "pay zone," and similar terms are to be given their broadest possible meanings and would include all locations, areas, and geological features within the earth that contain, may contain, or are believed to contain, hydrogen, carbon dioxide, helium, and/or dihydrogen sulfide.

As used herein, unless specified otherwise, the terms "field," "oil field," "gas field," and similar terms, are to be given their broadest possible meanings, and would include any area of land, sea floor, or water that is loosely or directly associated with a geologic formation, and more particularly with a resource containing formation, thus, a field may have one or more exploratory and producing wells associated with it, a field may have one or more governmental body or private resource leases associated with it, and one or more field(s) may be directly associated with a resource containing formation.

As used herein, unless specified otherwise, the terms "conventional hydrogen", "conventional carbon dioxide", "conventional helium", "conventional dihydrogen sulfide", "conventional natural gas", "conventional", "conventional production", and similar such terms are to be given their broadest possible meaning and include hydrogen, carbon dioxide, helium, or dihydrogen sulfide that are trapped in structures in the earth. Generally, in these conventional formations the hydrogen, carbon dioxide, helium, dihydrogen sulfide, or natural gas have migrated in permeable, or semi-permeable formations to a trap, or area where they are accumulated. Typically, in conventional formations a non-porous, relatively impermeable layer is above, or encompassing the area of accumulated hydrogen, carbon dioxide, helium, dihydrogen sulfide, or natural gas, in essence trapping the hydrogen, carbon dioxide, helium, dihydrogen sulfide, or natural gas in the accumulation. Conventional reservoirs have been historically the sources of the vast majority of hydrogen, carbon dioxide, helium, and dihydrogen sulfide observed. As used herein, unless specified otherwise, the terms "unconventional hydrogen", "unconventional carbon dioxide", "unconventional helium", "unconventional dihydrogen sulfide", "unconventional natural gas", "unconventional", "unconventional production" and similar such terms are to be given their broadest possible meaning and includes hydrogen, carbon dioxide, helium, dihydrogen sulfide, or natural gas that are held in impermeable rock, or which have not migrated to traps or areas of accumulation.

As used herein, unless specifically stated otherwise, the term "acoustic velocity" should be given its broadest possible meaning, and generally refers to the rate (in distance per time units, e.g., feet per second) at which sound waves travel through a medium.

As used herein, unless specifically stated otherwise, the terms "slowness" and "acoustic slowness" should be given their broadest possible meaning, and generally refers to rate (in time per distance units, e.g., seconds/feet) at which a medium transmits sound waves.

As used herein, unless specifically stated otherwise, the term "interval transit time" should be given its broadest possible meaning, and generally refers to the amount of time required for a sound wave to traverse a specified interval at the slowness corresponding to the interval's lithology.

As used herein, unless specifically stated otherwise, the term "acoustic impedance" should be given its broadest possible meaning, and generally refers to the multiplicative product of acoustic velocity and density of a medium (in $kg \times m^{-2} \times s^{-1}$ or the equivalent imperial units).

As used herein, unless stated otherwise, room temperature is 25° C. And, standard temperature and pressure is 25° C. and 1 atmosphere.

Generally, the term "about" as used herein unless specified otherwise is meant to encompass a variance or range of ±10%, the experimental or instrument error associated with obtaining the stated value, and preferably the larger of these.

As used herein unless specified otherwise, the recitation of ranges of values herein is merely intended to serve as a shorthand method of referring individually to each separate value falling within the range. Unless otherwise indicated herein, each individual value within a range is incorporated into the specification as if it were individually recited herein.

The term "$CO_2e$" is used to define carbon dioxide equivalence of other, more potent greenhouse gases, to carbon dioxide (i.e., methane and nitrous oxide) on a global warming potential basis of 100 years, based on IPCC AR5 methodology. The term "carbon intensity" is taken to mean the lifecycle $CO_2e$ generated per unit mass of a product.

$CO_2$ is widely recognized as a greenhouse gas (GHG), and the continued accumulation of $CO_2$ and other GHGs in the atmosphere is expected to cause problematic changes to global ecosystems and contribute to myriad other problems, such as ocean acidification and sea level rise. The two primary causes of carbon emissions globally are the use of fossil fuels for power generation and transportation.

Given the risks of $CO_2$ emissions, significant work has gone into finding replacements to existing high carbon energy sources, or ways to decarbonize existing energy sources. However, many of these low carbon alternatives have been uneconomic or not dispatchable enough to replace the current options.

In power generation, the alternatives to the highly reliable, low cost, but high emission sources (gas and coal) are either dispatchable and expensive (e.g., nuclear, hydroelectric, green hydrogen, or blue hydrogen), or inexpensive and intermittent (e.g., solar and wind, green hydrogen in some cases). There is only one existing source that is both lower cost and dispatchable, and that is geothermal. However, geothermal resources are limited, many of the economically productive geothermal resources have already been developed and are nearing end of life, and many geothermal resources are already in decline. As such, the growth outlook for geothermal energy resources is limited without significant technical advances.

Green hydrogen (hydrogen produced from water without the utilization of fossil fuels), which is generated by electrolysis powered from either solar, wind, hydroelectric, or geothermal energy may be a reliable source of low carbon energy when coupled with storage, but high capital cost, intermittent production due to intermittent energy sources or high cost of energy when grid connected, and the high cost and low availability of suitable hydrogen storage resources limits applicability. In addition, electrolysis consumes significantly more energy to produce the hydrogen than what is stored in the hydrogen, resulting in a low round trip efficiency in the system.

Blue hydrogen faces a similar set of problems to green hydrogen: it takes a low cost, high emission fuel source like coal or natural gas, and by adding expensive and parasitic carbon capture facilities, converts this low-cost-high-emission source of energy into a high-cost-low-emission source. Thus, even though large volumes of hydrogen may be formed in processes that subsequently prevent greenhouse gas emissions from reaching the atmosphere, the newly developed hydrogen resource is not cost competitive with other forms of energy derived from fossil fuels. Additionally, the challenges around finding carbon sequestration resources that may be used to permanently store the captured carbon from these processes result in limited opportunities to deploy these technologies today.

Natural hydrogen (or "gold hydrogen"), produced from the subsurface by drilling and producing wells may provide an abundant source of low emission, low cost, fully dispatchable energy.

Each of these energy sources and their inherent advantages and limitations are also relevant to transportation. When considering transportation fuels, by far the major sources of fuel are diesel and gasoline, both derived from crude oil production. Additionally, in recent years, electric vehicles have been gaining market share, but the cost for electric vehicles is still more expensive than fossil fueled equivalents and limitations exist regarding cost, recharge time, and primary resources for battery and energy storage. Given the weight of batteries, electric long-haul trucking is also challenging, and most long-haul truck manufacturers are in search of affordable, low carbon options such as hydrogen-fueled trucking.

If proven, natural hydrogen would be an answer to the low carbon, low cost, reliable transportation problem for long-haul trucking and potentially other forms of transportation. As for other types of transportation, natural hydrogen as a compressed or liquified product, or as a feedstock for synthetic liquid fuel ("efuels"), would be a reliable low cost, low carbon solution. Additionally, natural hydrogen could be combined with nitrogen to produce a carbon free ammonia product, which is being widely discussed as a potential replacement for bunker fuel for shipping.

Direct Emissions Reduction: Because there are no direct $CO_2$ emissions from the combustion or typical use of hydrogen, the reduction in $CO_2$ emissions is a function of what the hydrogen is replacing. In many cases, low carbon hydrogen would be replacing hydrogen from steam methane reforming (SMR) as a chemical feedstock for ammonia production, oil refining, and other chemical manufacturing. In some cases, low carbon hydrogen may replace natural gas, diesel fuel, gasoline, or jet fuel as a heat source or transportation fuel.

In the case of ammonia production and refining, natural gas is used to produce hydrogen via steam methane reformation reactions, which is used as a chemical feedstock in both the refining process and the ammonia production process. Today, more than 95% of hydrogen is produced using natural gas in steam methane reformers (SMRs). The carbon intensity of hydrogen production using SMRs without carbon capture is 10.4 tonnes of $CO_2$ emitted for each tonne of hydrogen produced. As such, direct replacement of natural hydrogen for hydrogen manufactured by SMR processes results in a $CO_2$ reduction of 10.4 tonnes $CO_2$/tonne $H_2$.

In power generation with gas turbines, hydrogen must displace the energy (btu) equivalent of natural gas. The energy density of hydrogen is 290 btu/cf or 51,682 btu/lb. By comparison, the energy density of natural gas is 983 btu/cf or 20,267 btu/lb, while the carbon intensity of natural gas is 52.91 kg $CO_2$/mmbtu $CH_4$ or 54.87 kg $CO_2$/mcf $CH_4$, or 3.5 kg $CO_2$/kg $CH_4$.

Because hydrogen is 2.6 times more energy dense per unit mass than natural gas, only 40% of the gross tonnage of fuel is required to achieve the same energy output. As such, burning one tonne of $H_2$ for power generation reduces natural gas consumption by ~2.6 tonnes, and thus $CO_2$ emissions by 9.1 tonnes.

Comparing natural hydrogen to hydrogen produced by electrolysis, the carbon reduction is a function of the carbon intensity of the power used in the electrolysis process. However, although there may be large indirect emissions associated with electrolysis, there are no direct emissions. Thus, natural hydrogen does not result in a direct emissions reduction as compared to electrolytically produced hydrogen.

Indirect Emissions Reduction: An analysis of the lifecycle carbon intensity of natural hydrogen using the Oil Production Greenhouse Gas Emissions Estimator ("OPGEE") has shown the lifecycle carbon intensity of natural hydrogen to be in the range of 0.1 to 0.4 tonnes $CO_2$/tonne $H_2$. Similar studies are not available for other methods of hydrogen production. However, using an average grid intensity of 0.5 tonnes $CO_2$/MWh, and given that electrolysis requires approximately 50 MWh/tonne $H_2$ produced, the indirect emissions associated with electrolysis are about 25 tonnes $CO_2$/tonne $H_2$ produced assuming grid power. Of course, electrolysis unit operators may purchase Renewable Energy Credits to synthetically reduce the carbon footprint of their power usage, but market recognition of this as a method for eliminating real time carbon emissions may not be permanent.

The realization of abundant natural hydrogen may achieve significant reductions in equivalent carbon emissions.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method for drilling a borehole to a depth of geologic hydrogen in a rock formation, the method comprising:

identifying a geological area of interest;

determining a rock matrix type of the rock formation at the geological area of interest;

determining a porosity of the rock formation;

determining a fluid density of a fluid within a pore space of the rock formation;

determining an acoustic slowness of the fluid within the pore space;

differentiating the geologic hydrogen from hydrocarbon fluids or other subsurface fluids within the fluid using geophysical acoustic logs;

differentiating the geologic hydrogen from water within the fluid using geophysical density logs;

flagging the differentiated geologic hydrogen, wherein the flagging includes providing the depth within the rock formation having geophysical properties indicative of a presence or an amount of the differentiated geologic hydrogen; and in response to determining the differentiated geologic hydrogen, drilling a borehole in the rock formation to the depth of the differentiated geologic hydrogen.

2. The method of claim 1 wherein determining the rock matrix type of the rock formation at the geological area of interest, determining the porosity of the rock formation, determining the fluid density of the fluid within the pore space of the rock formation, and determining the acoustic slowness of the fluid within the pore space are repeated at a plurality of subsurface intervals within a subsurface formation using well log data to identify one or more locations of the geologic hydrogen throughout the geological formation.

3. The method of claim 1, further comprising determining a relative amount of the geologic hydrogen within the rock formation.

4. The method of claim 3 wherein determining the rock matrix type of the rock formation at the geological area of interest, determining the porosity of the rock formation, determining the fluid density of the fluid within the pore space of the rock formation, determining the acoustic slowness of the fluid within the pore space, and determining the relative amount of the geologic hydrogen within the rock formation are repeated over time within a subsurface formation using new well log data each time to identify depletion or storage of the geologic hydrogen within the rock formation.

5. The method of claim 1, further comprising one or more of planning or drilling one or more wells at locations flagged with the presence of geologic hydrogen.

6. A system for drilling a borehole to a depth of geologic hydrogen in a rock formation, the system comprising:

a computing device having a processor and memory storage operably coupled to the processor, the memory storage storing one or more operational programs including machine readable and executable instructions that, when executed, cause the computing device to:

determine a rock matrix type of the rock formation at a geological area of interest;

determine a porosity of the rock formation;

determine a fluid density of a fluid within a pore space of the rock formation;

determine an acoustic slowness of the fluid within the pore space;

differentiate the geologic hydrogen from hydrocarbon fluids or other subsurface fluids within the fluid using geophysical acoustic logs;

differentiate the geologic hydrogen from water within the fluid using geophysical density logs;

flag the differentiated geologic hydrogen, wherein flagging includes providing the depth within the rock formation having geophysical properties indicative of a presence or an amount of the differentiated geologic hydrogen; and a drill rig configured to drill the borehole in the geological area of interest to the depth of the differentiated geologic hydrogen in response to the computing device determining the differentiated geologic hydrogen.

7. The system of claim 6 wherein the machine readable and executable instructions to determine a rock matrix type of a rock formation at a geological area of interest include instructions to examine one or more well logs for geophysical properties indicating a rock matrix type.

8. The system of claim 6 wherein the machine readable and executable instructions to determine porosity of the rock formation include instructions for obtaining porosity data from one or more well logs.

9. The system of claim 6 wherein the machine readable and executable instructions to determine the fluid density of the fluid within the pore space include instructions to calculate the fluid density of the fluid within the pore space by solving for $\rho_{fluid}$ using an equation, $\rho_{log}=(\Phi)*\rho_{fluid}+(1-\Phi)*\rho_{matrix}$, where:

$\rho_{log}$=bulk density measured by a density log tool (g/cm$^3$);

$\Phi$=porosity of the rock formation expressed as a fraction;

$\rho_{fluid}$=fluid density of the fluid contained in pore space of the rock formation (g/cm$^3$);

$1-\Phi$=volume fraction of rock matrix in the rock formation expressed as a fraction; and $\rho_{matrix}$=density of the rock matrix (g/cm$^3$).

10. The system of claim 6 wherein the machine readable and executable instructions to determine the acoustic slowness of the fluid within the pore space includes include instructions to calculate the acoustic slowness of the fluid within the pore space by solving for $\Delta t_{fluid}$ using an equation, $\Delta t_{log}=(\Phi)*\Delta t_{fluid}+(1-\Phi)*\Delta t_{matrix}$ where:

$\Delta t_{log}$=bulk acoustic slowness within the rock formation (μs/ft);

$\Phi$=porosity of the rock formation expressed as a fraction;

$\Delta t_{fluid}$=acoustic slowness of the fluid contained in the pore space of the rock formation (μs/ft);

$1-\Phi$=volume fraction of rock in the rock formation expressed as a fraction; and $\Delta t_{matrix}$=acoustic slowness of the rock matrix.

11. The system of claim 6 wherein the computing device is further configured to determine a presence of the geologic hydrogen within the pore space, wherein the machine readable and executable instructions to determine the presence of the geologic hydrogen within the pore space include instructions to correlate a fluid density and an acoustic slowness of the fluid within the pore space to a known combination of fluid density and acoustic slowness of one or more of hydrogen, methane, hydrogen, helium, water, or carbon dioxide.

12. The system of claim 6 wherein the machine readable and executable instructions include instructions to identify a geological area of interest having a geological formation containing the rock matrix therein.

13. The system of claim 6 wherein the machine readable and executable instructions include instructions to determine a relative amount of the geologic hydrogen within the pore space.

14. The system of claim 6 wherein differentiating the geologic hydrogen within a rock formation is based on data from one or more well logs, wherein the data from the one or more well logs indicate one or more of the rock matrix type, the porosity of the rock formation, the fluid density of the fluid within the pore space of the rock formation, or the acoustic slowness of the fluid within the pore space of the rock formation.

15. The system of claim 6, further comprising a communication interface in electronic communication with the computing device and one or more electronic data sources remote from the computing device.

16. The system of claim 15 wherein the one or more electronic data sources store one or more well logs.

17. The system of claim 16, wherein the one or more electronic data sources include a server, a cloud-based memory storage, or an additional computing device remotely located from the computing device.

* * * * *